US011649696B2

(12) United States Patent
Angman et al.

(10) Patent No.: US 11,649,696 B2
(45) Date of Patent: May 16, 2023

(54) WIRELINE COMPLETION TOOL AND METHOD

(71) Applicant: KOBOLD CORPORATION, Calgary (CA)

(72) Inventors: Per Angman, Calgary (CA); Mark Andreychuk, Calgary (CA)

( * ) Notice: Subject to any disclaimer, the term of this patent is extended or adjusted under 35 U.S.C. 154(b) by 0 days.

(21) Appl. No.: 17/488,211

(22) Filed: Sep. 28, 2021

(65) Prior Publication Data

US 2022/0098956 A1 Mar. 31, 2022

Related U.S. Application Data

(60) Provisional application No. 63/084,437, filed on Sep. 28, 2020.

(51) Int. Cl.

| | |
|---|---|
| ***E21B 23/14*** | (2006.01) |
| ***E21B 33/129*** | (2006.01) |
| ***E21B 34/14*** | (2006.01) |
| ***E21B 23/06*** | (2006.01) |

(52) U.S. Cl.

CPC ..... *E21B 34/14* (2013.01); *E21B 23/06* (2013.01); *E21B 23/14* (2013.01); *E21B 33/1294* (2013.01); *E21B 2200/06* (2020.05)

(58) Field of Classification Search

CPC ..... E21B 23/14; E21B 33/1294; E21B 34/14

See application file for complete search history.

(56) References Cited

U.S. PATENT DOCUMENTS

| | | | | |
|---|---|---|---|---|
| 9,133,671 | B2 * | 9/2015 | Kellner | E21B 34/14 |
| 9,366,109 | B2 * | 6/2016 | Themig | E21B 34/14 |
| 9,840,891 | B2 * | 12/2017 | Lee | F16H 25/2025 |
| 11,333,003 | B2 * | 5/2022 | Hardesty | E21B 23/03 |
| 2020/0131880 | A1 * | 4/2020 | Macrae | E21B 34/10 |
| 2021/0381340 | A1 * | 12/2021 | Patel | E21B 34/14 |

* cited by examiner

*Primary Examiner* — Matthew R Buck

(74) *Attorney, Agent, or Firm* — Parlee McLaws, LLP

(57) ABSTRACT

Apparatus and methods are provided relating bottom hole assemblies (BHA) electrically connected to a wireline. The BHA adapted for manipulating one or more target sleeve valves spaced along a wellbore having a sleeve shifting tool and a sealing element. The system can be shifted open by fluid pressure or electrically actuated stroking and closed by electrically actuated stroking. Methods of deploying a BHA for fracturing operations connected by wireline in a casing of a wellbore are also provided including obtaining real time sensor data from the BHA.

19 Claims, 32 Drawing Sheets

Fig. 4Aii

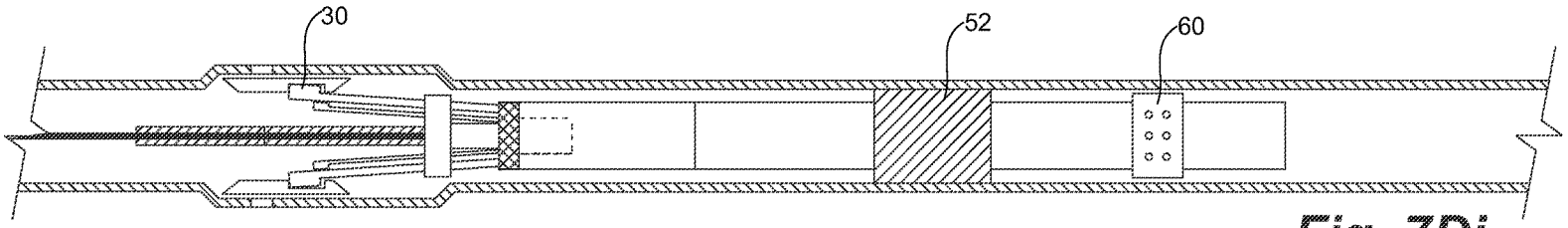
Fig. 7Di
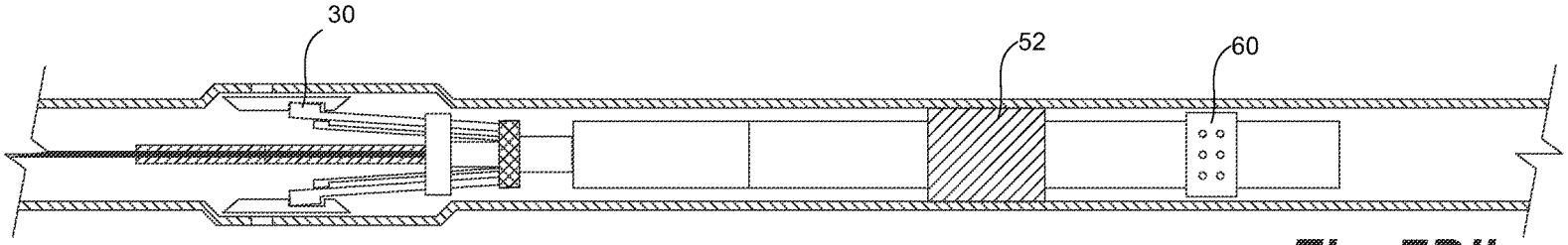
Fig. 7Dii
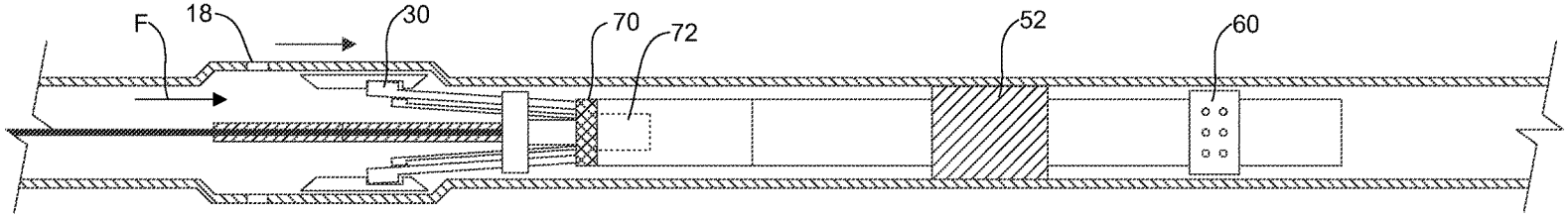
Fig. 7Ei
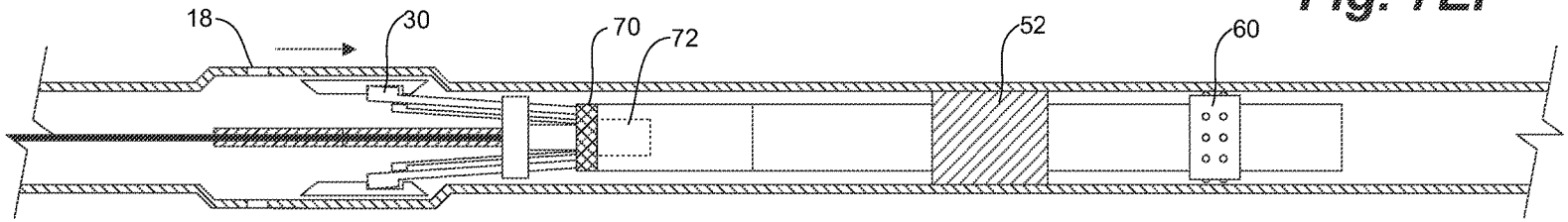
Fig. 7Eii

WIRELINE COMPLETION TOOL AND METHOD

FIELD

Embodiments of the disclosure relate to methods and apparatus used for completion of a wellbore and, more particularly, to wireline-connected apparatus and methods for performing completion operations and monitoring downhole conditions in real-time and at surface during fracturing operations.

BACKGROUND

Apparatus and methods are known for single-trip completions of deviated wellbores, such as horizontal wellbores. To date the completions industry, unlike the drilling industry which commonly utilizes intelligent apparatus for drilling wellbores in horizontal or deviated wellbores, the fracturing industry has relied largely on mechanically-actuated apparatus and well logs to locate tools in the wellbore so as to perform a majority of the operations required to complete a wellbore. This is particularly the case with wireline-deployed bottom hole assemblies (BHAs), largely due to the difficulty in providing sufficient and reliable electrical signals and power from surface to the BHA and from the BHA to surface. Further, bore restrictions, necessitated by current instrumentation subs, limit flow rates therethrough to less than 700 L/min, which is generally insufficient for contemporary fracturing operations.

It is known to deploy BHAs for facilitating completion operations using jointed tubulars, wireline, or cable, and coiled tubing (CT). One class of prior methodology for performing downhole operations uses a shifting tool that is run in hole for manipulating sleeve assemblies or valves. The shifting tool is conveyed downhole on tubulars or tubing typically on CT. A BHA at a distal end of the CT is fit with the shifting tool. The BHA selectively engages sliding sleeves of the sleeve valves spaced along casing with the shifting tool, accessing multiple zones in the formation. The conveyance tubing is manipulated to control the shifting tool which engages the sliding sleeves. The sliding sleeves are manipulated to open pre-existing ports at each sleeve. The BHA includes a packer which is set in the wellbore below the ports to enable fluid treatment through open ports thereabove. In other embodiments, the shifting tool can also be used to close selected sleeves to enable fluid treatment through opened ports in other sleeves.

Treatment fluid can be delivered downhole along the wellbore to the selected zone of the formation through the annulus between the wellbore casing and the CT, or, in some cases, through the CT, or through both at the same time. The fluid is directed through the opened ports. Typical CT conveyed BHAs comprise mechanically-operated downhole shifting tools having telescoping mandrels, packers, and tubing, controlled by axially delimited J-mechanisms for selecting a variety of operating modes. Fracturing operations using CT require specific surface equipment, including CT injection units.

Many fracturing operations, commonly in the US Midwest, utilize wireline, rather than CT to perform downhole operations. Unlike CT, wireline is unable to "push" a BHA downhole and is also limited in its ability to withstand significant tensile "pulling" forces. The maximum tensile load of conventional wireline is generally insufficient to overcome resistive forces for initiating an uphole, sliding operation of the sleeves. Further, because wireline lacks the rigid structure of CT, downhole shifting of the sleeves has the additional problem that the bendable wireline cannot transmit a "pushing force" applied from surface to the BHA and the sleeve engaged therewith.

As will be appreciated by those of skill in the art, the acquisition of data representing downhole conditions before, during and after a frac is useful to the operators. Multi-zone fracturing is characterized by setting a packer and introduction of proppant-loaded treatment fluid at high pressure to a zone or stage, then repeated release, pressure equalization, and re-location of the BHA to subsequent stages. Downhole conditions for completion operations are determined with electronic sensors and have been typically stored in memory tools carried by the BHA. The stored data is typically downloaded and reviewed at surface after the BHA is pulled out of hole. A disadvantage of storing data to on-board memory is that the downhole conditions are not known until downhole operations are already completed and after the BHA has been retrieved to surface. As such, the operator cannot adjust the operating parameters of the BHA and fracturing operation in real-time to respond to downhole conditions during the operation.

Real-time tools have been applied in downhole operations such as fracturing and drilling. Downhole parameters related to the downhole drilling environment and parameters have not been directly ascertainable at surface, and as a result, the operator is typically only provided with indirect data through surface measurements, such as reactive torque and string weight variation, to gauge downhole performance. Absent direct downhole data regarding wellbore conditions at the BHA, which may be located thousands of meters from surface, too much or too little string weight can be applied at surface resulting in downhole tool damage or ineffective rate of penetration when drilling.

With added complexity, some coiled-tubing conveyed BHAs are capable of acquiring real-time data and delivering said data to surface, such as that disclosed in published international application WO 2018/137027, incorporated herein in its entirety. An electrically enabled CT, or e-coil, which forms a non-rotating conveyance string, can conduct data readings uphole during drilling. The BHA is fit with a variety of sensors including pressure and acceleration, for gathering downhole parameters relating to the drilling interface. Such real-time e-coil is robust, in part due to the fixed arrangement which has no moving parts. However, movement of the BHA is related to fatigue connection issues. Thus, these applications are suited to fixed assemblies of components which are not subject to repeated movement and no relative movement therealong.

Unfortunately, currently in hydraulic fracturing, the a CT conveyed BHA is subject to repeated and relative axial movement to set the packer and cycle the J-mechanism, and is further subjected to high fluid rates of abrasive, proppant loaded fluids, thus creating hostile conditions for such real-time instrumentation subs.

Further, as wireline lacks the protection offered by CT frac operations utilizing, wireline is especially vulnerable to proppant wear at the ports, where frac fluid abruptly changes from an axial to a radial direction to flow out to the wellbore, resulting in turbulent flow.

There is interest in the industry for a downhole fracturing system that avoids the complexity and limitations of CT-conveyed tools, enables the real-time communication of data between surface and a downhole tool, and to improve access to operational data at the downhole tool for increasing the reliability and effectiveness of hydraulic fracturing operations.

SUMMARY

Herein, the inherent limitations of wireline are overcome with an electrically enabled bottom hole assembly (BHA), particularly in the manipulation of downhole sleeve assemblies for completion operations. Further, the monitoring of pressure uphole and downhole of the BHA during fracturing operations enables measurements indicative of how the formation is reacting to the fracturing operation and may also be indicative of the integrity of the isolation effectiveness of the BHA and the characteristics of the formation between adjacent zones. Instead of calculating or estimating downhole parameters from parameters measurable at surface, or reviewing data at a later date as recovered from memory stored on downhole tools, downhole data is recovered at surface in real-time. Issues with downhole applications involving wireline are managed with using electric actuators, packers, electric sleeve shifters, and protective sleeves and tubes.

Surface equipment, such as trucks used for wireline fracturing operations, has a lower cost than CT units and is more readily available in many areas of North America. Use of the disclosed wireline BHA, which can be applied to downhole sleeve assemblies obviates operations to clean up the wellbore for production as may be required in some applications using plugs or dissolvable plugs. The use of the wireline BHA to manipulate sleeve assemblies and utilize the full bore of a wellbore casing, means that no reduction in diameter is required as would be in conventional applications using plugs or ball-drop and dart actuated sleeves.

Herein, a downhole fracturing tool is provided comprising electrically enabled wireline, an interface sub and an electrically-actuated BHA.

In a broad aspect, a BHA electrically connected to a wireline, the BHA adapted for manipulating one or more target sleeve valves spaced along a wellbore, includes a shifting tool and a sealing element. The shifting tool having an element and electrically actuable between a radially outward biased position, a radially outward engaged position, and a radially inward collapsed position. The sealing element electrically actuable between a radially outward sealing position and a radially inward released position. When the shifting tool element is in the biased position, the BHA can be moved along the wellbore and the shifting tool element is adapted to engage a sleeve of a target sleeve valve. When the shifting tool element is in the engaged position, the shifting tool is locked axially to the target sleeve for operation of the target sleeve valve and adapted to open or close the target sleeve valve. When the sealing element is the sealing position, an annulus between the wellbore and the BHA is blocked to direct annular fluid through an opened sleeve valve. When the shifting tool element is in the collapsed position, the BHA can be moved along the wellbore.

In an embodiment, the BHA also includes electrically actuable slips actuable between a wellbore-engaged position and a released position, wherein when the slips are in the wellbore-engaged position, the slips are engaged with the wellbore and the BHA is restrained to the wellbore.

In an embodiment, the BHA also includes electrically actuable slips actuable between a wellbore-engaged position and a released position and an electrically-actuated axial stroking tool located between the slips and the shifting tool. When the slips are in the wellbore-engaged position, the slips are engaged with the wellbore, the shifting tool is engaged with the target sleeve, and the stroking tool can operate the target sleeve valve between the open and closed or closed and open positions.

In an embodiment, the BHA also includes an instrumentation sub having one or more sensors for measuring one or more parameters of the wellbore and BHA, the sensors in communication through the wireline.

In an embodiment, the shifting tool element includes a housing, an actuator and one or more dogs. The one or more dogs are supported by the housing and radially actuable by the actuator between the biased position, the engaged position and the collapsed position.

In an embodiment, the sleeves include axial engagement ends and the shifting tool element is adapted to engage the sleeves at one or both of the engagement ends to open or close the target sleeve valve.

In an embodiment, the shifting tool element includes a housing, an actuator, a mandrel and a set of fingers. The mandrel is axially moveable within the housing by the actuator and has at least three diameters. The set of fingers is radially actuable by the mandrel between the biased position corresponding to a first diameter of the mandrel, the engaged position corresponding to a second diameter of the mandrel, and the collapsed position corresponding to a third diameter of the mandrel.

In another broad aspect, a method of deploying a BHA for fracturing operations connected by wireline in a casing of a wellbore includes pumping fluid into the wellbore to position the BHA, radially extending a shifting tool element of the BHA to a biased position to engage walls of a sleeve, pulling the BHA by the wireline uphole until the shifting tool element of the BHA engages recesses of the sleeve, setting the shifting tool element of the BHA to an engaged position to axially lock the shifting tool element to the sleeve, setting a sealing element in the casing to isolate an annular area between the wellbore and the BHA, pumping fluid into the wellbore to open the sleeve, pumping fracturing fluid into the annular area, unsetting the sealing element in the casing, waiting for pressure uphole and downhole the sealing element to equalize, retracting the shifting tool element to a collapsed position, and pulling the BHA uphole with wireline to the next sleeve.

In an embodiment, the method also includes setting a set of slips to engage the casing, and closing the sleeve by axially stroking the shifting tool element while the BHA is axially fixed to the casing.

In an embodiment, the method also includes measuring axial force on the wireline using a sensor and communicating axial force measurements through the wireline for observing wireline load.

In an embodiment, the step of pulling the BHA by the wireline uphole includes measuring axial force on the wireline using a sensor and communicating axial force measurements through the wireline to determine whether the shifting tool element is in a biased position, an engaged position or a collapsed position.

In an embodiment, the step of setting the sealing element includes measuring pressure proximate the sealing element using a sensor and communicating pressure measurements through the wireline to determine whether the sealing element is in a sealing position or a released position.

In an embodiment, the step of pumping fracturing fluid into the annular area includes measuring pressure uphole and downhole of the sealing element in the wellbore using sensors and communicating pressure measurements through the wireline for confirming a level of isolation provided by the sealing element.

In an embodiment, the step of pumping fracturing fluid into the annular area includes measuring fluid pressure in the wellbore using a sensor and communicating pressure measurements through the wireline for observing parameters of a potential screen-out of the wellbore.

In another broad aspect, a method of deploying a BHA for fracturing operations connected by wireline in a casing of a wellbore includes pumping fluid into the wellbore to position the BHA, radially extending a shifting tool element of the BHA to a biased position to engage walls of a sleeve, pulling the BHA by the wireline uphole until the shifting tool element of the BHA engages recesses of the sleeve, setting the shifting tool element of the BHA to an engaged position to axially lock the shifting tool element to the sleeve, setting a set of slips to engage the casing, opening the sleeve by axially stroking the shifting tool element while the BHA is axially fixed to the casing, setting a sealing element in the casing to isolate an annular area between the wellbore and the BHA, pumping fracturing fluid into the annular area, unsetting the sealing element in the casing, waiting for pressure uphole and downhole the sealing element to equalize, closing the sleeve by axially stroking the shifting tool element while the BHA is axially fixed to the casing;

releasing the set of slips, retracting the shifting tool element to a collapsed position, and pulling the BHA uphole with wireline to the next sleeve.

In an embodiment, the method also includes measuring axial force on the wireline using a sensor and communicating axial force measurements through the wireline for observing wireline load.

In an embodiment, the step of pulling the BHA by the wireline uphole includes measuring axial force on the wireline using a sensor and communicating axial force measurements through the wireline to determine whether the shifting tool element is in a biased position, an engaged position or a collapsed position.

In an embodiment, the step of setting the sealing element includes measuring pressure proximate the sealing element using a sensor and communicating pressure measurements through the wireline to determine whether the sealing element is in a sealing position or a released position.

In an embodiment, the step of pumping fracturing fluid into the annular area includes measuring pressure uphole and downhole of the sealing element in the wellbore using sensors and communicating pressure measurements through the wireline for confirming a level of isolation provided by the sealing element.

In an embodiment, the step of pumping fracturing fluid into the annular area includes measuring fluid pressure in the wellbore using a sensor and communicating pressure measurements through the wireline for observing parameters of a potential screen-out of the wellbore.

BRIEF DESCRIPTION OF THE DRAWINGS

FIG. 4E illustrates the open-close BHA having been pumped downhole of a sleeve valve of interest, the shifting valve having been actuated the engage the wellbore casing the open-close BHA being pulled uphole by the wireline until the shifting tool engages the sleeve;

FIG. 4F illustrates the shifting tool engaged with the sleeve and the BHA having been anchored to the wellbore for stroking the shifting tool and engaged sleeve to an opened position in this embodiment, or closed as appropriate in an alternate completion operation, and an elastomeric sealing element being actuated isolate the wellbore annulus;

FIG. 4G illustrates treating the formation through the opened ports above the isolated annulus;

FIG. 5A illustrates the BHA being pumped downhole into location with fluid;

FIG. 5B illustrates dogs being activated in the BHA to engage the wellbore casing;

FIG. 5C illustrates the BHA being pulled uphole by the wireline until the dogs engage a profile in the sleeve valve's sleeve;

FIG. 5D illustrates the dogs locked to the sleeve set of slips being set to anchor the BHA to the casing, an elastomeric sealing element being set to isolate an annular area and in this embodiment use fluid pressure on the packer to shift the sleeve downhole and open the ports;

FIG. 5E illustrates treating the formation with fluid through the opened ports;

FIG. 5F illustrating release of the shifting tool after fluid treatment, the elastomeric sealing element deflated, the dogs radially collapsed and the stroking mechanism reset, if applicable;

FIG. 6A illustrates the BHA being pumped downhole into location with fluid;

FIG. 6B illustrates fingers being activated in the BHA to engage the wellbore casing;

FIG. 6C illustrates the BHA being pulled uphole by the wireline until the fingers engage the sleeve;

FIGS. 6D and 6E illustrate the elastomeric sealing element being set to isolate an annular area and fluid being pumped against the sealing element to drive the BHA and shifting tool downhole to shift the sleeve open;

FIG. 6F illustrates the sealing element being released from the wellbore, the fingers retracted, and the stroking mechanism being reset, if applicable.

FIGS. 7A to 7I are schematic side views of a portion of a wellbore in a formation, illustrating a sleeve valve and a BHA located thereat, the figures illustrating a sequence of steps to deploy and use a dual action BHA for both opening and closing sleeves;

FIG. 7A illustrates the BHA being pumped downhole into location;

FIG. 7B illustrates the BHA extending dogs (shown), or alternatively fingers, and being pulled uphole to locate a sleeve profile of a target sleeve valve;

FIG. 7C illustrates the dogs/fingers being locked in place;

FIG. 7Di illustrates the actuating the stroking mechanism to a retracted position and actuating an elastomeric sealing element to engage the wellbore;

FIG. 7Dii illustrates actuating an elastomeric sealing element to engage the wellbore;

FIG. 7Ei illustrates using fluid pressure on the packer to shift the sleeve downhole and open the ports;

FIG. 7Eii illustrates the slips being set to the wellbore for restraining the BHA and illustrates actuating the stroking mechanism, pushing against the slip, to open the sleeve;

FIG. 7F illustrates directing fluid through the opened ports to the formation;

FIG. 7G illustrates actuating the stroking mechanism, pushing against the slip, to close the sleeve after treating the formation;

FIGS. 7H and 7I illustrates the sealing element being deflated, the dogs/fingers being retracted and the stroking mechanism being reset;

DETAILED DESCRIPTION

Figure 1A:
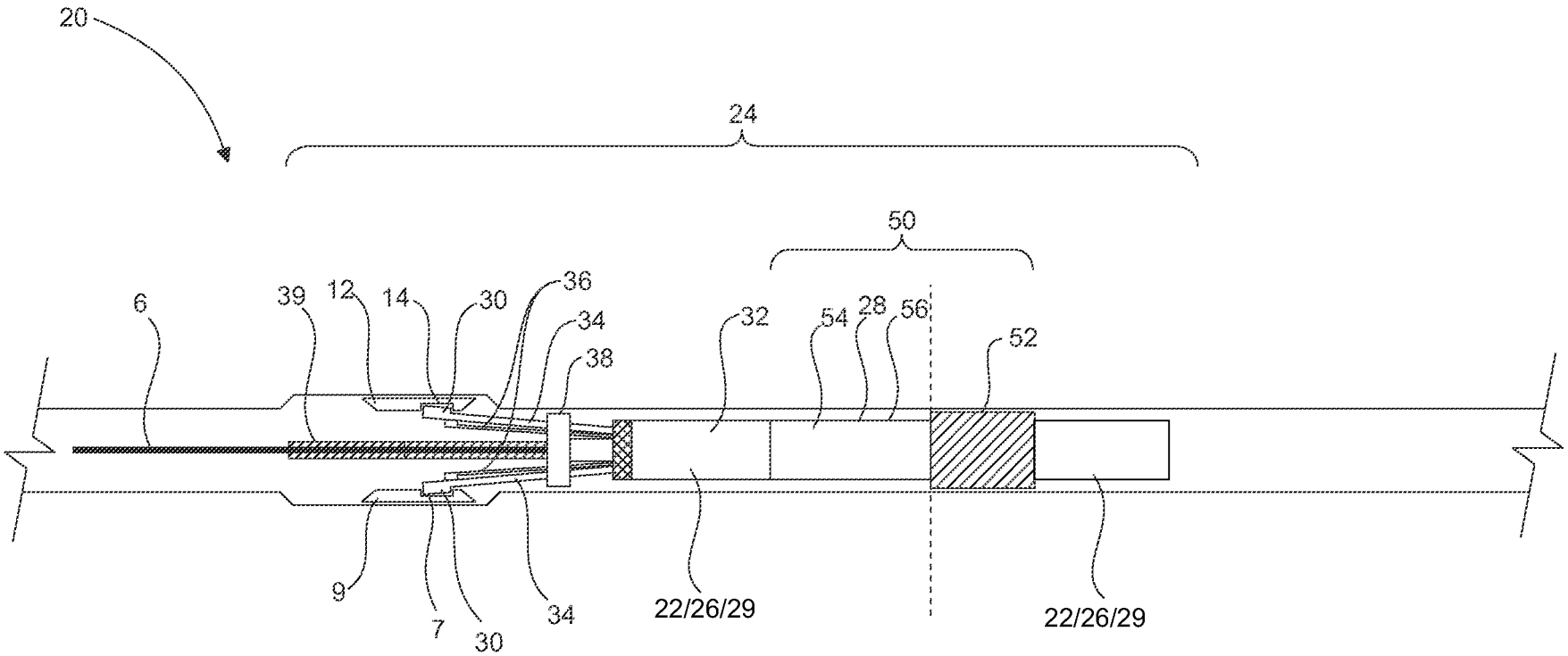
FIG. 1A is a schematic side view of an embodiment of a wireline-conveyed bottom hole assembly (BHA) conveyed through a cased completion string of a wellbore and located at a downhole sleeve assembly, the formation and any cement omitted for better illustrating the casing and downhole tool.

Embodiments are described herein in the context of fracturing operations. However, systems and methods disclosed herein are also applicable to completion, stimulation, and other operations wherein it is desired to actuate downhole sleeve valves to control fluid flow into and out of a wellbore.

Embodiments described herein utilize electrically-actuated downhole tools incorporated into a bottom-hole assembly (BHA) 20 for completion of multiple zones of interest in a subterranean formation during a single trip into a wellbore 2 intersecting the formation. Use of electrically-actuated BHA components permits functionality heretofore unavailable in conventional, mechanically-actuated BHA components. In embodiments, separate electrically-actuated drive components permit independent, on-demand operation of BHA components, used individually or in combination, such as sleeve locating apparatus, isolation apparatus, perforating apparatus, fracturing subs, microseismic monitoring apparatus, and the like. Further, use of the electrically-actuated tools allows the BHA 20 to be more compact than conventional BHAs used for the same purposes, suitable for lubricator deployment in live pressurized wells. One further advantage is that tools incorporated in the BHA 20 are actuated electrically from surface and provide accurate times of actuation, which aid in more accurate monitoring of fracturing operations.

In embodiments, most, if not all, of the components of the BHA 20 are electrically-actuated. In other embodiments, only some of the components are electrically actuated and are used together with mechanically-actuated components.

While applicable to a variety of wellbore types, apparatus and methods described herein are shown as being used in deviated, horizontal, or directional wellbores and particularly those of very long or extended length.

The terms "uphole" and "downhole" used herein are applicable regardless the type of wellbore; "downhole" indicating being toward a distal end or toe of the wellbore 2 and "uphole" indicating being toward a proximal end or surface of the wellbore 2 or surface. Further, the terms "electronically-actuated" and "electrically-actuated" are used interchangeably herein and may be dependent upon the characteristics of the component being actuated. Additionally, the terms "electronically-actuated" and "electrically-actuated" can refer to any form of actuation using electric signals, such as driving a component via an electric motor or operating an electric pump of a hydraulic system.

The BHA 20, according to embodiments described herein, is deployed on a wireline 6. In embodiments, for example, the wireline 6 is a 7/32 inch or 9/32 inch hepta cable. Bi-directional communication for actuation of the electrically-actuated tools from surface, and receipt of data therefrom, is enabled via electrical conductors contained in the wireline 6. Any wireline 6 which provides sufficient electrical capability to actuate components in the BHA 20 as well as permitting communication between the BHA 20 and surface would be suitable for use in embodiments described herein.

Embodiments of the BHA 20 described herein are useful for treating or fracturing both cased or open wellbore.

Sleeve Assemblies

Sleeve assemblies 10 are generally incorporated within a completion string, such as a casing string 8, set in a wellbore 2 drilled through one or more reservoirs. The sleeve assemblies 10 comprise an outer tubular housing 16 having a housing bore formed therethrough and an internal tubular sleeve 12 axially moveable therein. An annulus is formed between the sleeve and the housing. The housing 16 defines one or more ports 18 through which fluids, such as fracturing fluid introduced from surface, can flow. The sleeve 12 is axially moveable between a closed position wherein the sleeve blocks the flow of fluid through the ports 18, and an open position, wherein the sleeve is shifted axially away from the ports 18, allowing the fluids to flow therethrough. In the depicted embodiments, the sleeves 12 are shifted downhole to the open position from an uphole closed position. In other embodiments, the sleeves 12 can be shifted uphole to the open position from a downhole closed position.

Uphole and downhole internal delimiting shoulders, such as adjacent an uphole end and a downhole end of the housing 16, protrude radially inwardly into the housing bore and engage uphole and downhole ends of the sleeve 12, respectively. Thus the distance the sleeve 12 can shift axially in the housing 16 between the open and closed positions is delimited with the shoulders.

Sleeves 12 in the completion string are generally located using a locating tool. Sleeves 12 are known to be located using a locating tool that engages an uphole stop within a radial locating recess or sleeve profile 14 formed in the sleeve bore and having an axial extent.

In embodiments, the initial shifting force required to actuate the sleeve 12 can be controlled using shear screws with predetermined shear strength being inserted through the sleeve housing 16 and sleeve 12. Once the shear value of the shear screws is overcome, shear screws break and the sleeve 12 is allowed to travel to the open position. The number of screws may be adjusted to desired operating parameters to achieve the desired initial actuation force.

As taught in Applicant's US published application US20170058644A1 (the '644 Application), incorporated herein by reference in its entirety, in embodiments separate locating and shifting tools are not required. A locating shifting tool is used to both locate and shift the sleeve and can be incorporated into a treatment tool taught therein, such as a frac tool.

Mechanical Shifting Tool

In Applicant's U.S. Pat. No. 10,472,928, incorporated herein by reference in its entirety, in embodiments a bottom hole sleeve actuator comprises dogs supported by radially controllable arms. In the '644 Application, a shifting tool was disclosed using keys or dogs for engaging a sleeve profile 14 of sleeves 12 of sleeve valves 10 located along a casing string 8. The shifting tool is incorporated as part of a BHA that is conveyed on a tubing string such as coiled tubing (CT). Dogs at the ends of radially controllable, circumferentially spaced support arms are actuated radially with a radial restraining means for controlling the radial positioning of the arms and dogs thereon. The dogs and arms are actuated radially inward with the restraining means to overcome radially outward biasing of the arms for uninhibited axial movement of the BHA through the wellbore. The dogs and arms can be released radially outwards for sleeve locating and sleeve profile engagement. The dogs can further be positively locked in the sleeve profile 14 for opening and closing of the sleeve 12.

As introduced in the '644 Application for a sleeve having a profile therein, the dogs of the shifting tool disclosed therein locate and engage the sleeve profile 14 intermediate the sleeve for sleeve release, opening, and closing. Manipulation of the arms and dogs is achieved using uphole and downhole movement of a shifting mandrel of a mechanical shifting mechanism having the restraining means fixed thereto, and a cam profile on the dog-supporting arms. The shifting mandrel can be moved axially relative to a housing of the shifting tool having the arms and dogs mounted thereon. The restraining means is a cam-encircling restraining ring supported on the shifting mandrel.

In embodiments described in the '644 Application, a tubing-conveyed system was provided comprising an actuating or shifting tool as described above that is used to sequentially manipulate a large number of sleeve valves located along a casing string 8 extending downhole in an oil or gas well. The well can be a vertical, deviated, or horizontal well. The shifting tool engages a sleeve and opens or closes the sleeve in its respective sleeve housing via uphole and downhole movement of the CT and shifting tool. Each sleeve valve can be manipulated, at any time, and for various reasons without tripping the tool from the wellbore. The shifting tool can be conveyed on the conveyance string, and incorporated with other components of a BHA conveyed on the conveyance string.

In greater detail, Applicant's BHA, as described in the '644 Application, is configured for run-in-hole (RIH) mode for free movement through downhole-to-open sleeve valves 10 and a downhole string such as a completion string 8. The sleeve valves 10 can comprise a tubular sleeve housing 16 fit with a tubular sleeve 12 as described above. Each sleeve 10 has an annular recess or dog-receiving sleeve profile 14 formed intermediate along its length for location and shifting of the sleeve using the shifting tool. The sleeve 12 is shiftable for opening and closing ports 18 in the housing 16. The profile 14 is annular and has a generally right angle uphole interface for positive sleeve profile locating purposes.

The shifting tool of the '644 Application relies purely on mechanical actuation of the shifting tool via forces conveyed from surface through the CT to the BHA, and relative movement of the shifting mandrel relative to the housing of the shifting tool, to actuate the dogs to their various positions for locating, engagement with, and actuation of the sleeve valves 10. Such relative movement of shifting tool components inhibits the use of electronic components on the BHA with electric connections to surface.

As taught in Applicant's US published application US20200024916A1, incorporated herein by reference in its entirety, a BHA having a shifting tool comprising a repositioning sub is used to open a sleeve with packer located outside the sleeve using fluid pressure.

As taught in Applicant's US published application US20210002980A1, incorporated herein by reference in its entirety, a BHA having a shifting tool uses a dual J-mechanism to pull up to open a sleeve and fluid pressure applied to a packer located downhole the sleeve to close an open sleeve.

Bottom Hole Assembly—Open-Only

Referring to FIG. 1A, an embodiment of an improved BHA 20 for use with a wireline 6 comprises an instrumentation sub 22 and a sleeve shifting tool 24. The instrumentation sub 22 can comprise one or more sensors 26, such as one or more of the following: a 3D directional sensor, a sensor adapted to measure pressure, a sensor adapted to determine axial movement, a sensor adapted to determine rotational movement, a temperature sensor, an axial force sensor and an accelerometer. The sleeve shifting tool 24 is adapted for actuating sleeve valves 10 within the borehole between a closed position and an open position, and comprises a housing 16 supporting a set of electrically-actuated dogs 30. The shifting tool 24 can further comprise an electrically-actuated sealing mechanism 50. In embodiments, the dogs 30 and the sealing mechanism 50 are hydraulic elements actuated by electric pumps. The instrumentation sub 22 can be located uphole or downhole of the sealing mechanism 50, or the BHA 20 can have two instrumentation subs 22, one sub 22 located uphole of the sealing mechanism 50 and the other sub 22 located downhole thereof. The instrumentation sub 22 can also house the electronic components necessary for actuating the electrically-actuated components of the BHA 20.

The sensors 26 located in the instrumentation sub 22 are useful for efficient operation of the methods disclosed herein. For example, the pressure sensor assists in determining the setting of packer and when pressure has equalized across a packer of the sealing mechanism 50 of the BHA 20 and the axial force sensor assists in determining wireline load and when the dogs 30 of the shifting tool 24 have engaged with a sleeve profile 14 of a target sleeve 12. Further, the sensors 26 allow real-time monitoring of pressure and temperature during fracturing operation both above and below the BHA 20 using appropriately positioned pressure and temperature sensors. Real-time data from the instrumentation sub 22 also allows an operator during a fracturing operation to recognize a potential screen-out and take steps to recover therefrom. For example, prior to a fracturing operation plugging off completely, pump pressure builds. Using the instrumentation sub 22 having a pressure sensor allows the operator to observe the pressure build up in real time downhole in the wellbore 2 rather than waiting for the pressure build up to manifest at the surface. As plugging can take from about 30 seconds to several minutes, the real time information allows for a more timely responsive action, for example, by reducing sand concentration to avoid screen-out.

In embodiments, for location of the BHA 20 within the wellbore 2, the BHA 20 further comprises an electronic casing collar locator 29 (CCL) which is capable of detecting casing collars located along the casing string 8 and which may also be capable of detecting perforations. The instrumentation sub 22 also comprises electronics associated with the operation of the CCL 29. For example, the CCL 29 can be configured to detect electric signals emitted by casing collars to determine the location of the BHA 20 in the wellbore 2. The electronically-actuated CCL 29 is useful throughout the completion operation for accurately determining the positioning of the BHA 20. Use of the sensors 26 of the instrumentation sub 12 and the CCL 29 provide the ability to confirm that the correct sleeve valves 10 are being opened, that the isolation is being set up in the correct location and that the isolation is working as intended by monitoring the sensors of the instrumentation sub 22, which is difficult to accomplish using CT-mounted mechanical BHAs and ball/dart drop systems.

In embodiments, the sleeve shifting tool 24 is connected to the downhole end of a wireline 6 and comprises a housing 28, a constrictor 38, a constrictor drive 32 located in or connected to the housing 28 and operatively connected to the constrictor 38, one or more radially extending dogs 30, a protective sleeve 39, and a sealing mechanism 50. Referring to FIG. 1, each dog 30 is supported on a corresponding pivotable arm 34. Each pivotable arm 34 is attached at one end to the dog 30 and at the other end to the housing 28. Each dog 30 is shaped and sized to engage the sleeve profiles 14 of the sleeves 12. In embodiments, the casing 8 is 4.5 inches to 5.5 inches in diameter with a pressure rating of at least 15,000 to 20,000 pounds per square inch (psi). In embodiments, the sleeve profiles 14 comprise a downhole engagement shoulder or an uphole engagement shoulder of the sleeves 12 located at a downhole end or an uphole end of the sleeves 12, as appropriate.

Figure 3:
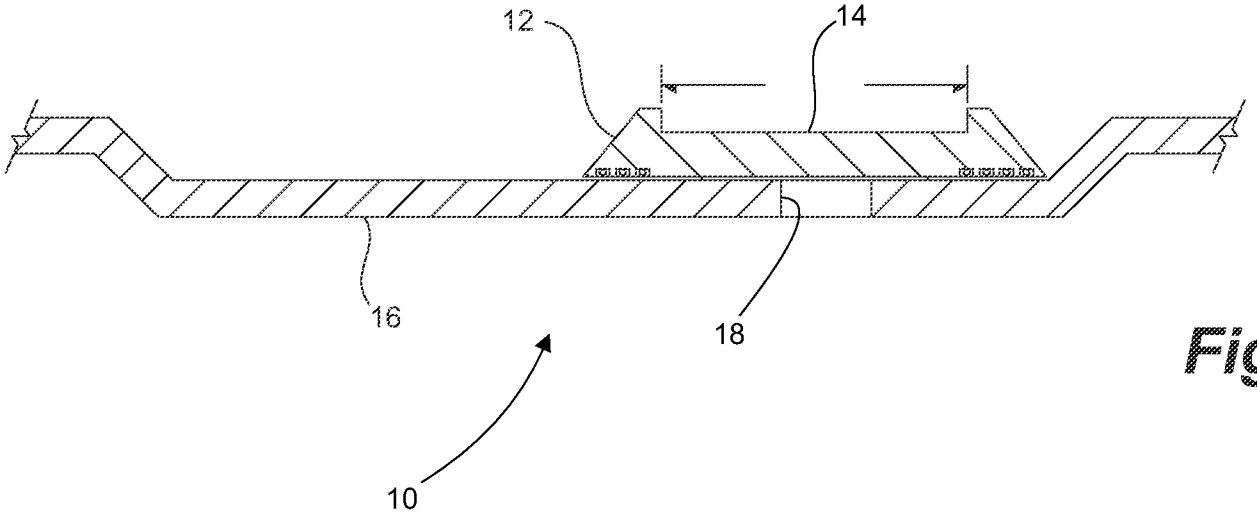
FIG. 3 is a side detail view of a profile in a sleeve for corresponding dog-type shifting tool.

Referring to FIGS. 1A and 3, the constrictor 38 is actuated by the constrictor drive 32. In embodiments, each dog 30 has three functional positions: (1) a sleeve profile-engaged position (SET) wherein the position of the pivotable arm 34 is locked in a radially outward position for engagement with a sleeve profile 14; (2) a radially outward biased position (LOC) for locating a sleeve profiles 14; and (3) a radially inward collapsed position (RET) for uninhibited movement of the BHA 20 through the casing 8 and sleeve valves 10. As each pivotable arm 34 pivots at its connection at the housing 28, the pivotable arm 34 may also be in any position between (1) and (3).

Referring to FIG. 1A, each pivotable arm 34 has a corresponding spring 36 that is used to bias the corresponding dog 30 outwardly from the wireline 6. The arms 34 are located radially within constrictor 38. The constrictor 38 is axially actuable relative to the housing 28 by the constrictor drive 32. When the constrictor 38 is moved axially uphole relative to the housing 28, the dogs 30 are forced radially inward and when the constrictor 38 is moved axially downhole relative to the housing 28, the dogs 30 move radially outward due to the biasing of the springs 26.

The constrictor drive 32 can be an electric motor configured to axially actuate the constrictor 38. In other embodiments, the constrictor drive 32 can comprise an electric fluid pump connected to a fluid reservoir and configured to actuate a piston coupled to the constrictor 38. Instructions regarding actuation of the constrictor 38 are sent from surface and communicated to the constrictor drive 32 via the wireline 6.

The arms 34 and the dogs 30 are held against the casing 8 with the force of the spring 36 and this force can be adjusted on a per dog basis or group basis as the case may be, such as via cam profiles of the arms 34. The springs 36 may be steel springs. Biasing springs can be cantilevered leaf or collet-like springs, the ends of each leaf radially biasing the dog arms outwardly. The force on the dogs 30 is also balanced even if the tool is not centralized in the wellbore 2. Only one dog 30 is required to engage the sleeve profile 14 to detect that the BHA 20 has located a sleeve 12. The dogs 30 are designed in such a way that one dog 30 alone can withstand the entire load capacity at surface. The force generally required to open a sleeve is around 5,000 pounds.

Referring to FIGS. 1A and 3, the sleeve profiles 14 and dogs 30 can be designed such that the dogs 30 do not locate and become caught in any gap or profile other than the sleeve profiles 14. For example, the dogs 30 can be configured to pass over annular gaps present between the bottom of the sleeve 12 and the sleeve housing 16 when the sleeve 12 is in the uphole closed position and the BHA 20 is being pulled uphole with the dogs 30 in the LOC position to locate the sleeve profile 14. For example, with reference to FIGS. 1A and 3, the inner diameter of the sleeves 12 can taper radially outwards towards their uphole and downhole ends such that the dogs 30 pass over said ends and do not engage them. When the BHA 20 is pulled uphole with the dogs 30 in the LOC position, the dogs 30 engage the locating profile 14 of a sleeve 12 as the BHA 20 passed thereby as discussed above, preventing the BHA 20 from traveling further uphole and providing positive indication, for example about 5,000 to about 10,000 daN, that the sleeve 12 has been located.

Figure 2A:
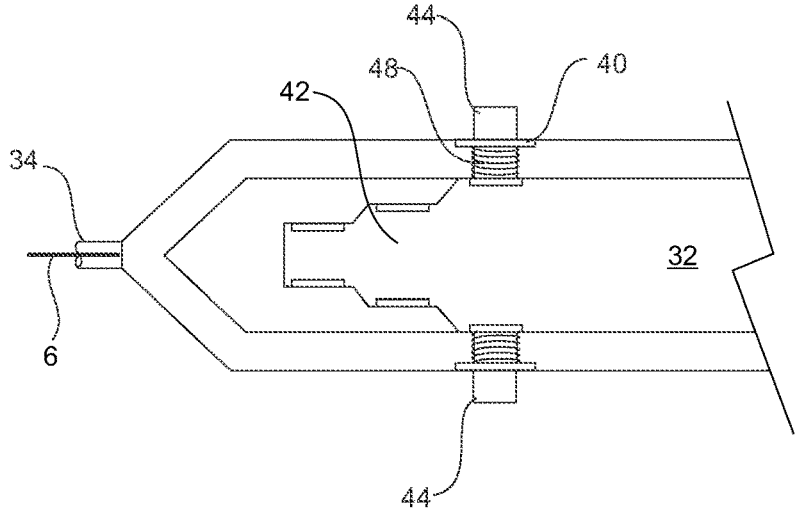
FIGS. 2A to 2C are schematic side views of a portion of the shifting tool having an alternative sleeve engaging and shifting device having radially extendable and retractable fingers.
Figure 2B:
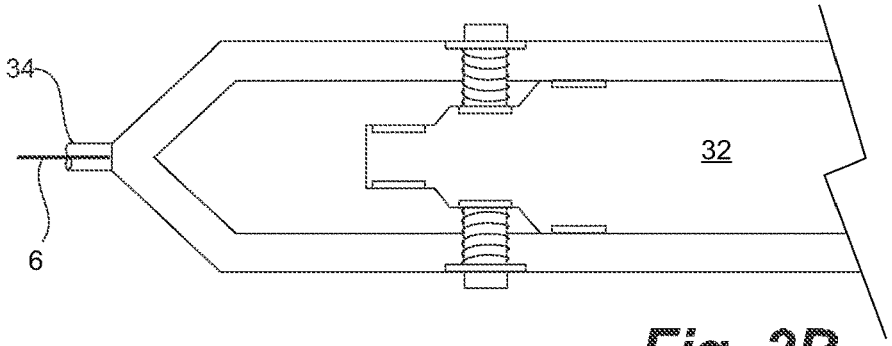
Figure 2C:
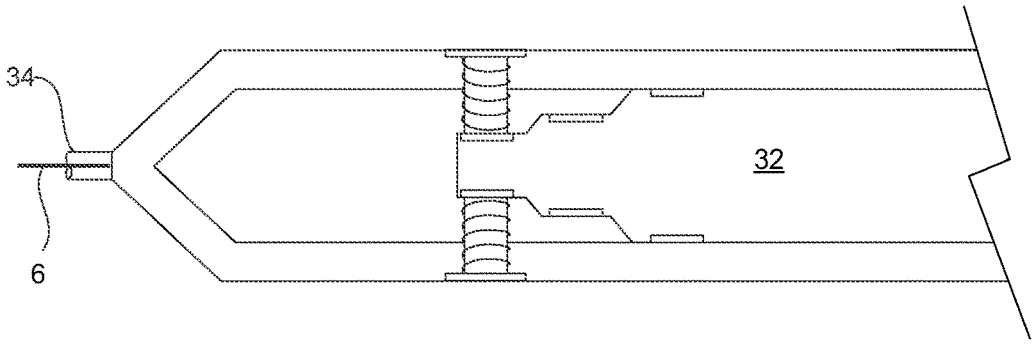
Figure 2D:
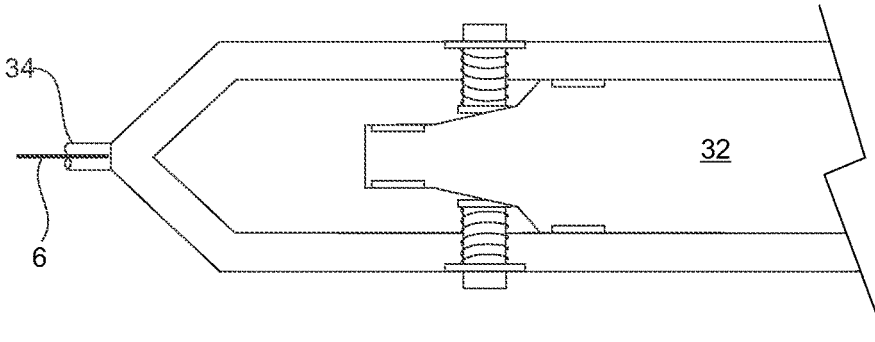
FIG. 2D is a schematic side view of portion of an alternative embodiment of the shifting tool having an alternative sleeve engaging and shifting device having radially extendable and retractable fingers having a partially tapered mandrel.

Referring to FIGS. 2A to 2C, an alternative sleeve locating and shifting device 24 using pins or fingers 44 and an actuation mandrel 42 is disclosed, which can be used in place of the dogs 30 and constrictor 38 described above. The sleeve locating and shifting device 40 comprises a set of fingers 44 sized and shaped to engage the sleeve profiles 14 of the sleeves 12 and pass over other profiles of the casing string 8 and sleeve valves 10. The fingers 44 are orientated radially from the shifting tool 14 and extendable radially to three functional positions: (1) a sleeve profile-engage position (SET) wherein the fingers 44 are locked in a radially outward position for engagement with a sleeve profile 14; (2) a radially outward biased position (LOC) used for locating the sleeve profiles 14 of sleeves 12; and (3) a radially retracted position (RET). The radial extension of the fingers 44 correspond to the relative axial position of a mandrel 42 axially moveable within the shifting tool 14 and having at least three distinct diameters. Each diameter corresponds to one of the positions (1) to (3) specified above respecting the functional positions of the fingers 44. The fingers 44 are radially inwardly biased with resilient biasing means, such as springs 48. The mandrel 42 is configured to actuate between three axial positions corresponding to the functional positions of the fingers 44. The three diameters can have gradual transitions between them to push the fingers 44 radially outwards when translating the mandrel 42 to move a larger diameter axially in-line with the fingers 44. Referring to FIG. 2D, in embodiments, the diameter of the mandrel 42 corresponding to the LOC position can have a tapering diameter.

With reference to FIGS. 2A to 2C, in another embodiment, the shifting tool 24 can have hydraulically actuated fingers 44 oriented radially and having three functional positions: (1) a sleeve profile-engage position (SET) wherein the fingers 44 are locked in a radially outward position for engagement with a sleeve profile 14; (2) a radially outward biased position (LOC) used for locating the sleeve profiles 14 of sleeves 12; and (3) a radially retracted position (RET). An electric pump in communication with a fluid reservoir of the shifting tool 24 can control fluid pressure applied to the fingers 44. The fingers 44 can be radially inwardly biased such as by a spring. In the SET mode, the pump increases the hydraulic pressure applied to the fingers 44 to drive them radially outwards to engage the sleeve profile 14. In the LOC mode, the pump applies a hydraulic pressure less than that applied in the SET mode to radially bias the fingers 44 outwards while still permitting the BHA 20 to move through the casing 8 and sleeve valve 10. In the RET mode, the pump can apply little or no pressure such that the fingers 44 are retracted radially inward due to the radially inward biasing, thus permitting the BHA 20 to move freely through the casing 8 and sleeve valves 10.

A mandrel drive 46 can be operatively connected to the mandrel 42 to actuate it axially and thus actuate the fingers 44 to their various functional positions. The mandrel drive 46 can be an electric motor configured to actuate the mandrel 42. In other embodiments, the mandrel drive 46 can comprise an electric fluid pump connected to a fluid reservoir and configured to actuate a piston coupled to the mandrel 42. Instructions regarding actuation of the mandrel 42 are sent from surface and communicated to the mandrel drive 46 via the wireline 6.

In the LOC position, the mandrel drive 46 can apply a constant force on the mandrel 42 to overcome the radially inward bias of the springs and apply a constant radially outward force on the fingers 44, such that the fingers 44 drag along the casing 8 and sleeve valves 10 as the BHA 20 moves therealong to locate a sleeve 12. Such constant radially outward force is further assisted by the mandrel 42 having a tapering diameter.

Referring to FIG. 1A, in embodiments, a protective tubular sleeve 39 is located on the wireline 6 extending uphole from the sleeve shifting tool 24. The protective tubular sleeve 39 can be made of any material suitable to resist wear from proppant fluid and should extend uphole at least to an axial location where the wireline 6 will be exposed to treatment/fracturing fluid F in the treatment area and at least uphole of the sleeve 12. For example, the protective sleeve 39 can be positioned to the area of the wireline 6 adjacent flow ports 18 of the sleeve housing 16 when the BHA 20 is engaged with the sleeve profile 14. The protective sleeve 39 may comprise a rope socket or any other appropriate protective means.

Referring to FIG. 1A, in embodiments, the sealing mechanism 50 can provide an annular seal between the BHA 20 and casing 8 and is located downhole from the dogs 30. In other embodiments, as shown in FIGS. 4B-4F, the sealing mechanism 50 can be located uphole from the dogs 30. The sealing mechanism 50 comprises an elastomeric sealing element 52 such as a packer, a fluid reservoir 54 and a pump 56. The pump 56 is electrically actuable and pumps fluid from the fluid reservoir 54 into the elastomeric sealing element 52, thereby actuating or inflating the elastomeric sealing element 52. In embodiments, when the sealing mechanism 50 is released, fluid is pumped by the pump 56 from the elastomeric sealing element 52 into the fluid reservoir 54 to deflate the sealing element 52. In embodiments, the sealing mechanism 50 can further comprise a bypass pressure valve across the uphole and downhole sides of the sealing element 52 as a further safety measure in the event the process does not function as expected.

In other embodiments, the sealing mechanism 50 can be actuated by any other suitable sealing actuation mechanism. For example, the sealing mechanism 50 can comprise an electric motor or hydraulic pump configured to actuate a piston to axially compress the sealing element 52 such that it expands radially outwards. Compressing the sealing element 52 a sufficient extent results in a sealing engagement between the sealing element 52 and the casing 8 or a sleeve 12.

As shown in FIGS. 4B-4F, the packer 52 of the sealing mechanism 50 can be located on the BHA 20 so as to be set within a sleeve 12 once the dogs 30/fingers 44 have located the sleeve profile 14 thereof. In other embodiments, as shown in FIGS. 5A-7I, the packer 52 can be located on the BHA 20 so as to be set in the casing 8 downhole of the sleeve 12. The latter embodiments may enable shorter sleeve 12 to be used, as said sleeve 12 do not need to have sufficient axial length to accommodate the setting of the packer 52 therein.

Open and Close Embodiment

The bendable characteristic of wireline 6 makes it unable to exert a "pushing" force required to shift a sleeve in the downhole direction while the tensile strength of the wireline 6 limits its ability to exert a "pulling" force required to shift a sleeve 12 in the uphole direction. The downhole pushing force can be exerted on the BHA 20 by partially expanding the sealing mechanism 50 and pumping fluid down the annulus 4 between the wireline 6/BHA 20 and the casing 8.

Figure 1B:
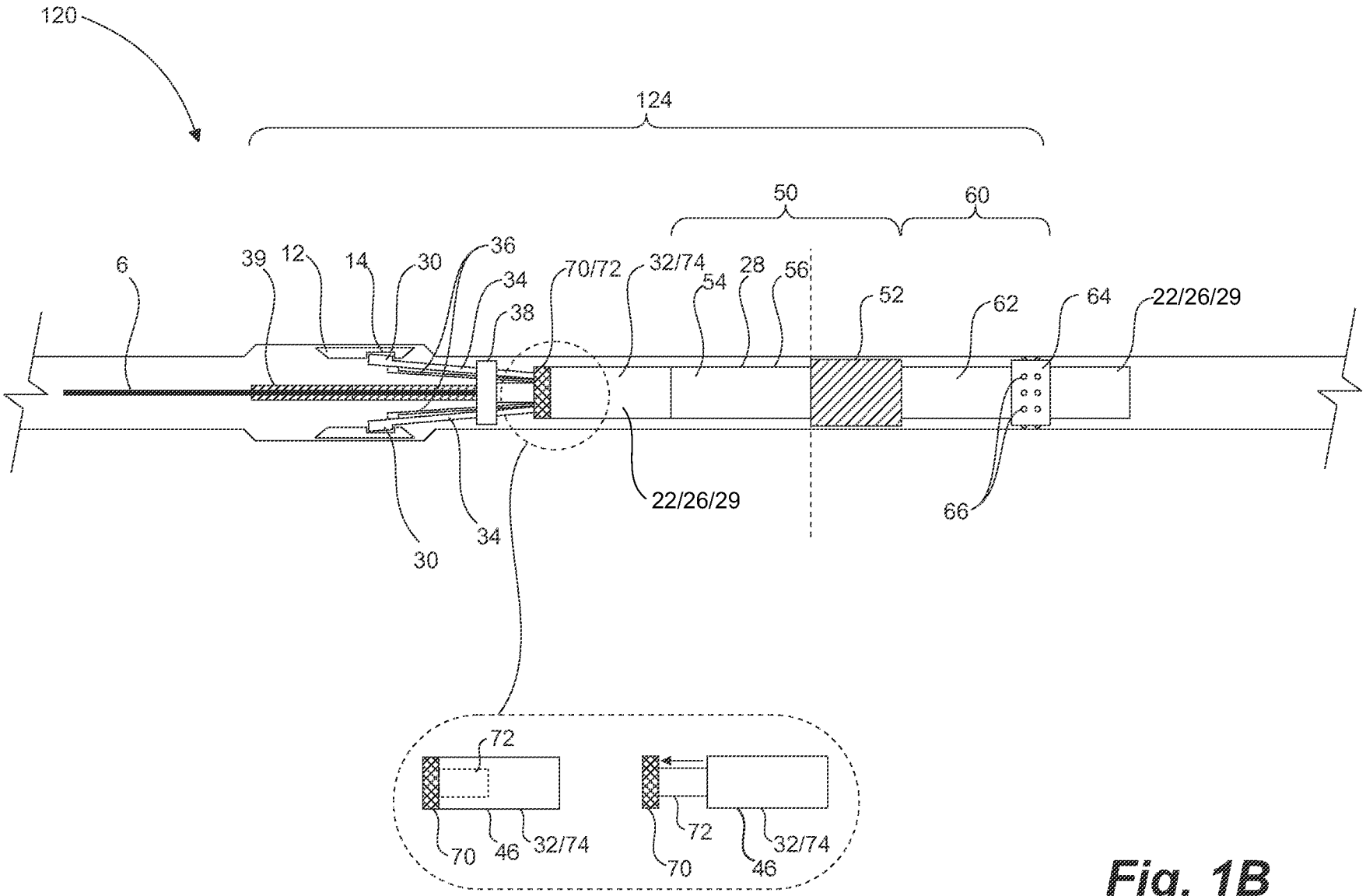
FIG. 1B is a side view of an embodiment of a wireline-conveyed BHA in a completion string having a shifting tool actuated by an electrically-enabled stroking mechanism.

Referring to FIG. 1B, another embodiment of the shifting tool 124 is shown having the capability to shift sleeves 12 in the uphole direction as well as the downhole direction. The dual action sleeve shifting tool 124 comprises the same components as the single action shifting tool 24, and further comprises a slip mechanism 60 and stroking mechanism 70 that enables the sleeve shifting tool 124 to shift sleeves 12 in the uphole direction, for example to close a sleeve 12 after treatment of the formation therethrough. In embodiments, the slip mechanism 60 and the stroking mechanism 70 of the sleeve shifting tool 124 can be used to shift sleeves 12 in the downhole direction, for example to close a sleeve 12 prior to treatment of the formation therethrough. The stroking mechanism 70 comprises a telescoping piston 72 capable of axially extending and retracting from the BHA housing 28. The arms 34 and dogs 30 supported thereon are mounted on the stroking mechanism 70. The stroking mechanism 70 can be axially actuated with a stroking drive 74 in the BHA so as to axially shift the piston 72, and the dogs 30 and arms 34, uphole and downhole. The slip mechanism 60 is secured to the BHA housing 28. When the BHA housing 28 is axially secured in the casing 8 such as with slip mechanism 60, and the dogs 30 are engaged with the sleeve profile 14 of a sleeve 12, the stroking mechanism 70 can be actuated to axially manipulate the sleeve 12 between the open and closed positions. The stroking mechanism 70 can have a stroke distance at least sufficient to enable it to actuate a sleeve 12 between the open and closed positions.

In embodiments, the stroking drive 74 can be an electric pump connected to a fluid reservoir and configured to hydraulically actuate the stroking piston 72 to telescopically actuate it between the extended and retracted positions relative to the BHA housing 28. In other embodiments, the stroking drive 74 can be an electric motor configured to drive the stroking piston 72 between the extended and retracted positions relative to the BHA housing 28. Any other suitable stroking drive 74 capable of actuating the stroking piston 72 between the extended and retracted positions may be used.

In embodiments, the stroking drive 74 is actuated independently of the constrictor drive 32/mandrel drive 46, while the constrictor 38 moves with the striking piston 72. In this manner, movement of the dogs 30/arms 34 with the stroking piston 72 does not change the functional position of the dogs 30, but the constrictor 38 can be actuated independently of the stroking piston 72 to change the functional position of the dogs 30.

Referring to FIG. 1B, in embodiments, the slip mechanism 60 comprises an electrically operated dual acting slip drive 62 and a slip arrangement 64 further comprising radially expandable slip elements 66 adapted to restrict axial movement in both uphole and downhole directions. The slip drive 62 can cause the slip elements 66 to radially expand and engage the casing 8, restricting axial movement of the BHA housing 28. In embodiments, the system of slips 60 has two functional modes: (1) disengaged with the slip elements 66 radially retracted; and (2) engaged with the slip elements 66 radially expanded and engaging the casing 8.

In an embodiment, the slip drive 62 can comprise an electric pump connected to a fluid reservoir and configured to pump fluid from the fluid reservoir into a fluid bladder radially inward of the slip elements 66. Expanding the bladder with the electric pump results in the slip elements 66 being radially expanded, while deflating the bladder with the pump results in the slip elements 66 being radially retracted. In another embodiment, the slip drive 62 can comprise an electric motor coupled to an annular cone configured to be axially driven into and away from radially inwardly biased slip elements 66. Driving the annular cone toward the slip elements 66 pushes said elements radially outward, while driving the cone away from the slip elements 66 permits the slip elements 66 to radially retract inward. In yet another embodiment, the cone can be coupled to a hydraulic piston which is driven using an electric pump. Any other suitable means of actuating the slips 60 between the engaged and disengaged positions may be used.

In embodiments, one or more of the constrictor drive 32/mandrel drive 46, sealing element pump 56, slip drive 62, and stroking drive 74 can be part of an integrated system. For example, all of the above drives can be hydraulic systems in communication with a common fluid reservoir, but having their own discrete pumps for actuating their respective devices.

Operation—Single Action

In use, having reference to FIG. 1A, a single-acting BHA 20 deployable using electrically-enabled wireline 6 is shown. When deployed into the wellbore 2, an annulus 4 is formed between the BHA 20 and the casing 8.

The BHA 20 comprises at least a sleeve shifting tool 24 and an instrumentation sub 22 further comprising a plurality of sensors 26.

In an embodiment, the BHA 20 is electrically connected to a distal end of the wireline 6. Electrical connection between the wireline 6 and the BHA's components can be accomplished in a number of ways, including but not limited to conductors extending therefrom through a bore of the BHA 20 or conductors extending therefrom through an electrical race formed about a periphery of the BHA's components. Electrical communication between surface and the components of the BHA 20 is thereby enabled via the connection with the wireline 6.

The casing 8 comprises a plurality of the ported sliding sleeve subs 10 spaced along the casing 8 or in a liner in the wellbore 2. The sleeves 12 of the sleeve subs 10 can be opened for permitting fluid communication through ports 18 formed in the sleeve housing 16.

Figure 4A:
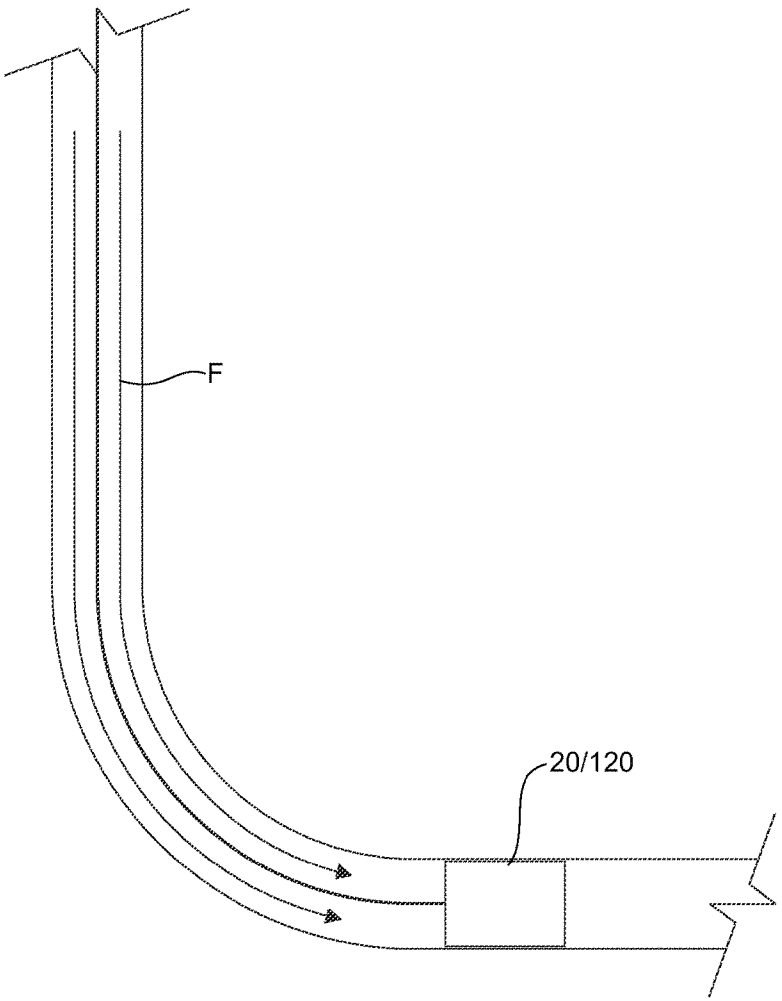
FIGS. 4Ai to 4D are schematic side views of a wellbore extending to a formation, illustrating an embodiment of an open-only BHA deployed in the wellbore (illustrations and references to the location of sleeves in FIGS. 4Ai to 4D are fanciful), and more particularly FIGS. 4Ai and 4Aii illustrate the open-only BHA being pumped downhole with fluid.
Figure 4A:
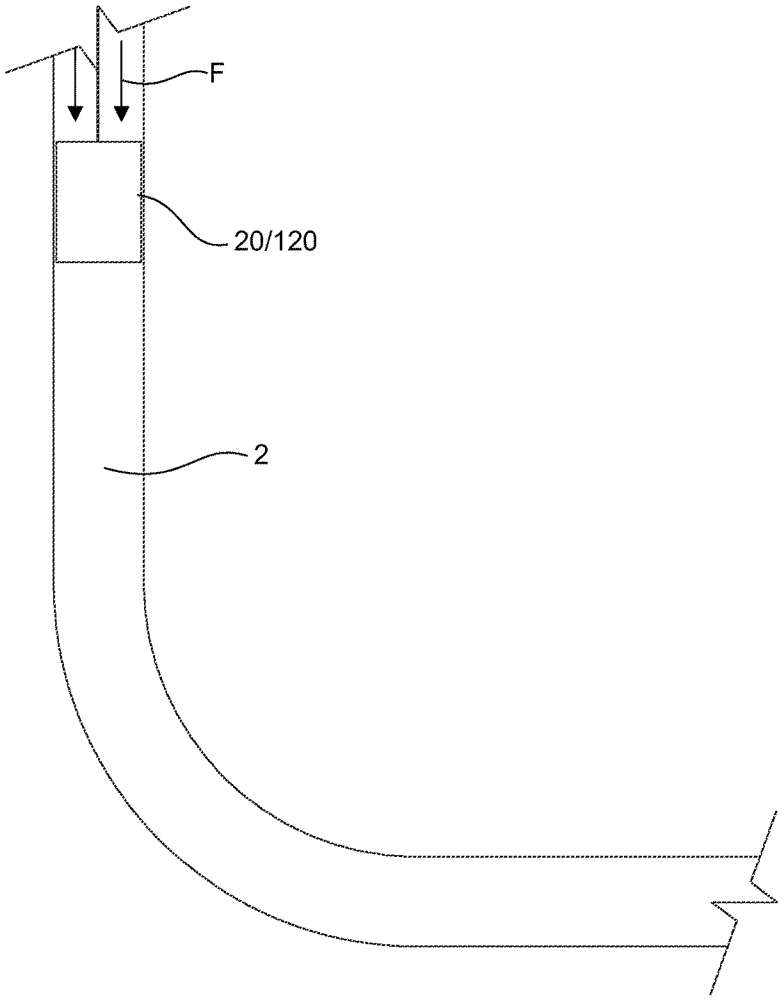
Figure 4B:
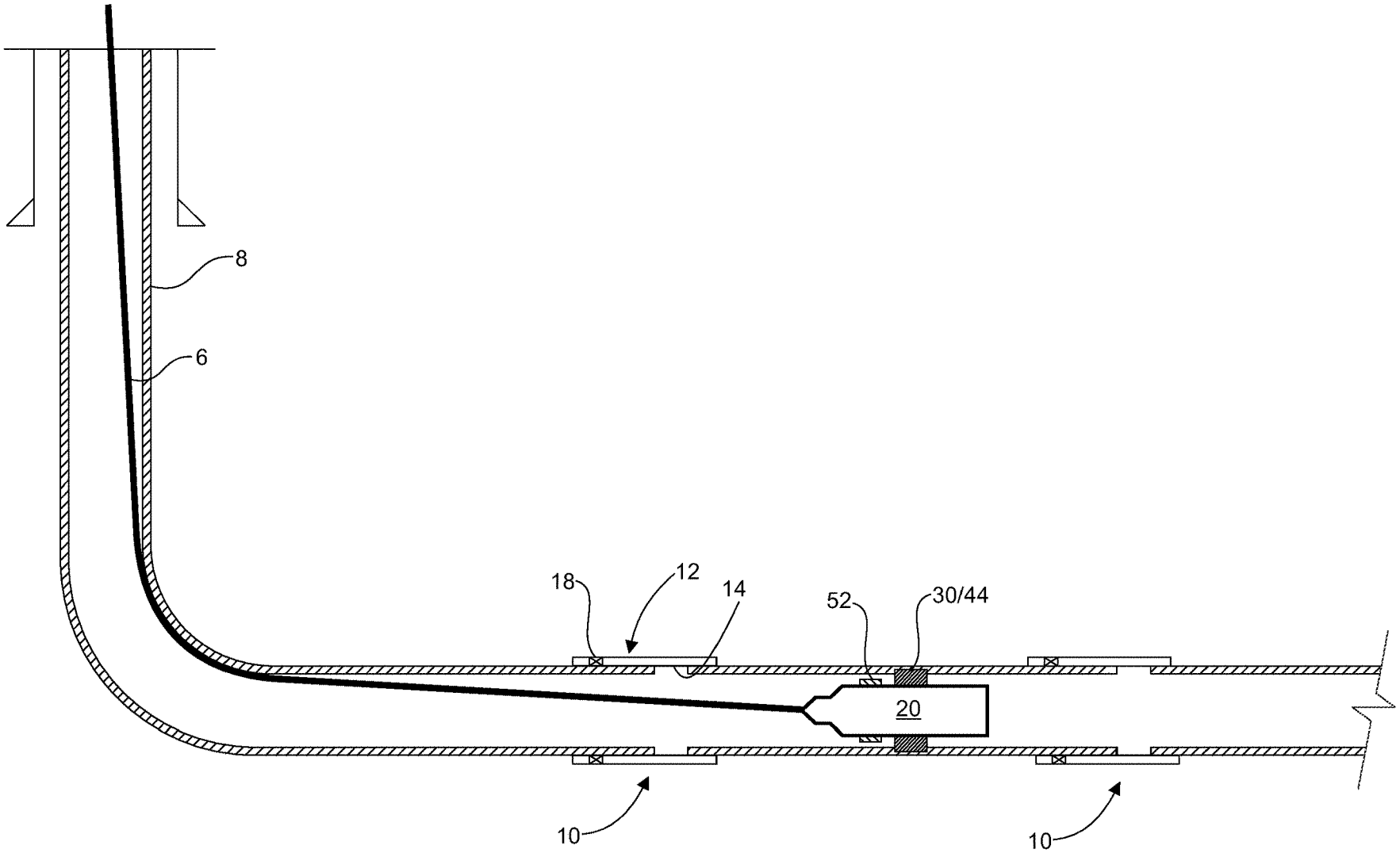
FIG. 4B illustrates dogs of the BHA's shifting tool being actuated to engage the wellbore casing as the BHA is pulled uphole by the wireline until the dogs engage the sleeve of a sleeve valve, as further shown in FIG. 4C.
Figure 4D:
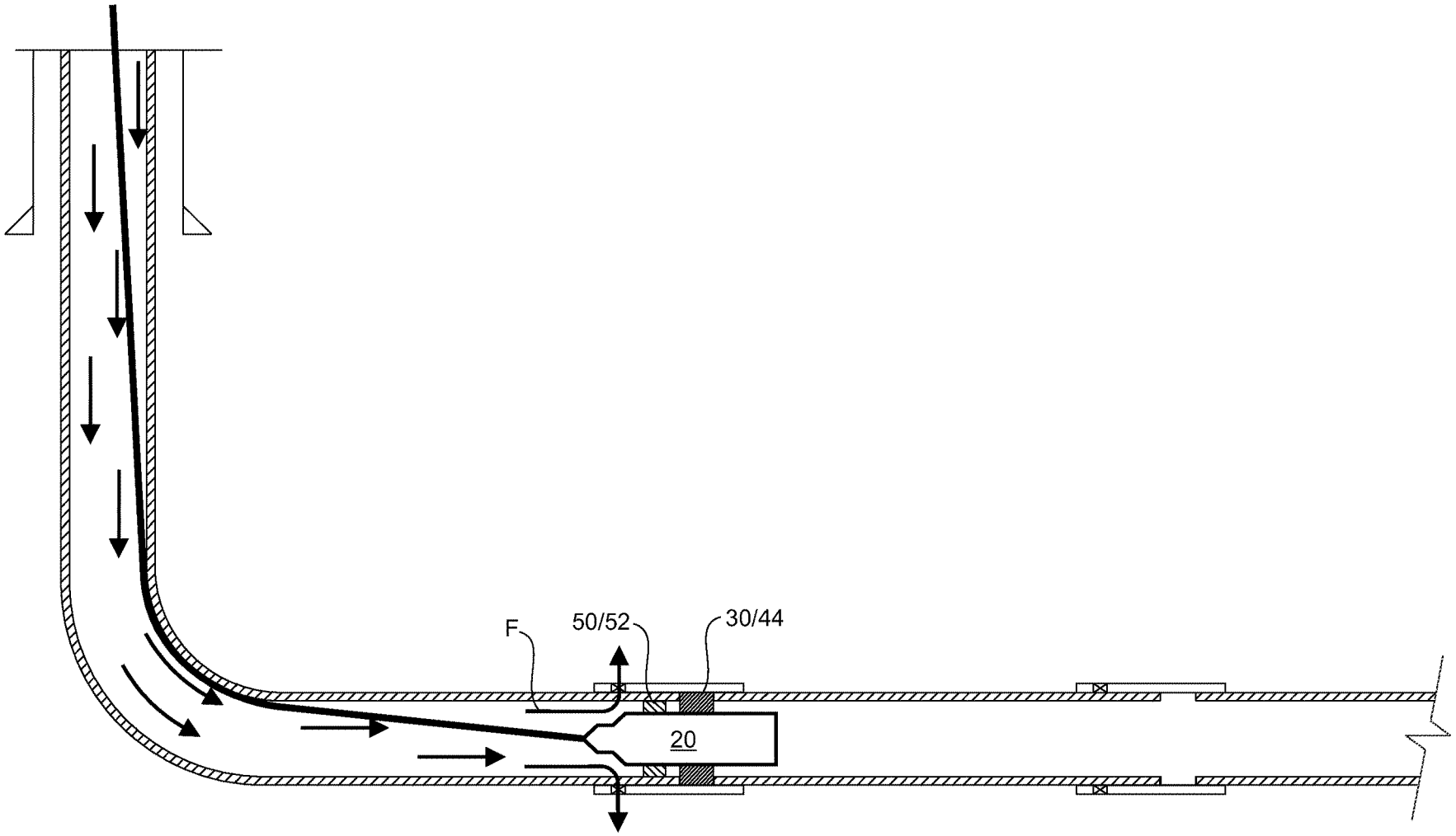
FIG. 4D illustrates treating the formation by directing treatment fluid down the annulus and out of the opened ports of the sleeve valve.
Figure 5A:
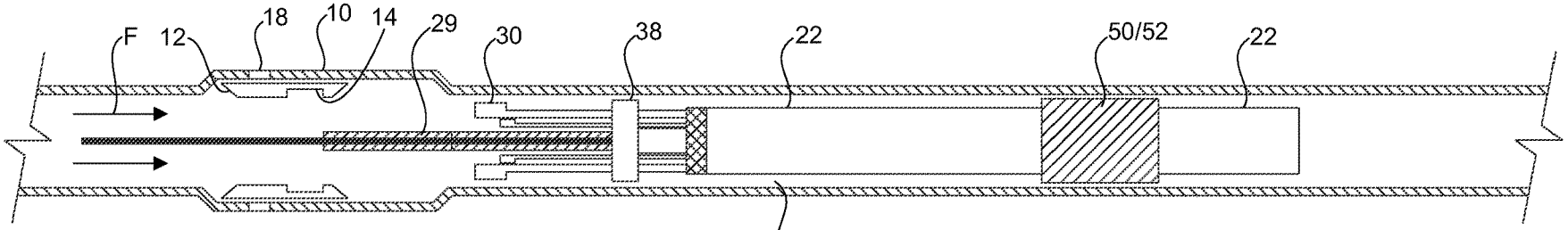
FIGS. 5A to 5F are schematic side views of a wellbore extending to a formation, illustrating a sequence of steps to deploy and use a BHA to open and close sleeves, the BHA having a shifting tool including dogs supported on arms, and more particularly.
Figure 5B:
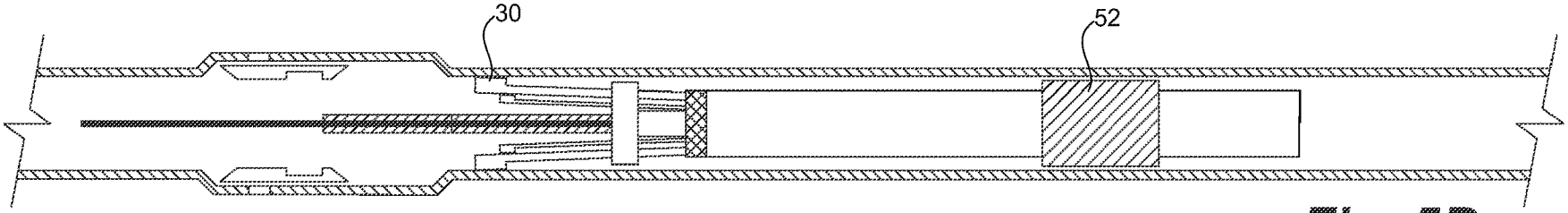
Figure 5C:
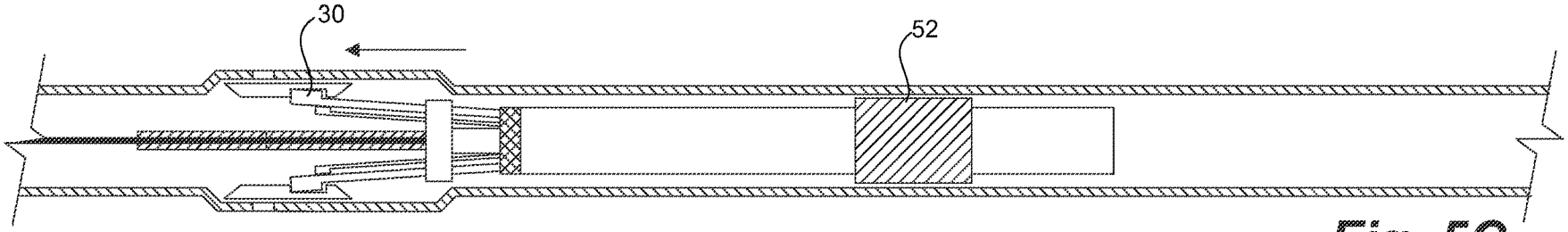

Lubrication can be applied to the BHA 20 prior to deployment. Referring to FIGS. 4A and 5A, in embodiments, the BHA 20 is positioned at the toe of the wellbore 2, or downhole of the most distal sleeve valve 10 from surface, by pumping fluid F. For example, for added conveying force, fluid F can be pumped down the wellbore 2 with the sealing mechanism 50 partially expanded so as to substantially fill the annulus 4 but not so much so as to engage the casing 8 and inhibit axial movement of the BHA 20. The sensors 26 and instrumentation sub 22 provide real-time readings, for example of axial tension force and pressure differential across the sealing mechanism 50, allowing the operator to adjust flow, packer expansion, and any other parameters while the BHA 20 is being run in hole. The casing collar locator 29 can also assist in correctly positioning the BHA 20 in the wellbore 2. Referring to FIGS. 4B and 5B, once the BHA 20 has been positioned below a selected sleeve valve 10, the dogs 30 of the BHA 20 are electrically actuated to the radially outward biased LOC position to engage the casing walls in locate mode with an amount of force that still permits some axial movement of the BHA 20 in the casing 8. Referring to FIGS. 4B and 5C, the BHA 20 can then be pulled by the wireline 6 uphole in the LOC mode such that the dogs 30 locate the sleeve profile 14 of the target sleeve valve 10 and extend therein once located. Referring to FIG. 4D, once the extended dogs 30 have located the sleeve profile 14, they are locked therein by actuating the dogs 30 to the SET mode. The location of the sleeve profile 14 by the dogs 30 is indicated by an increased axial tension force, which can be measured in real-time by the sensors 26 and observed by the operator at surface. In embodiments, the downhole end of the sleeve housing 16, the locating collar or lengths of adjacent casing are aggressively profiled to assist detection by the extended dogs 30.

Figure 4C:
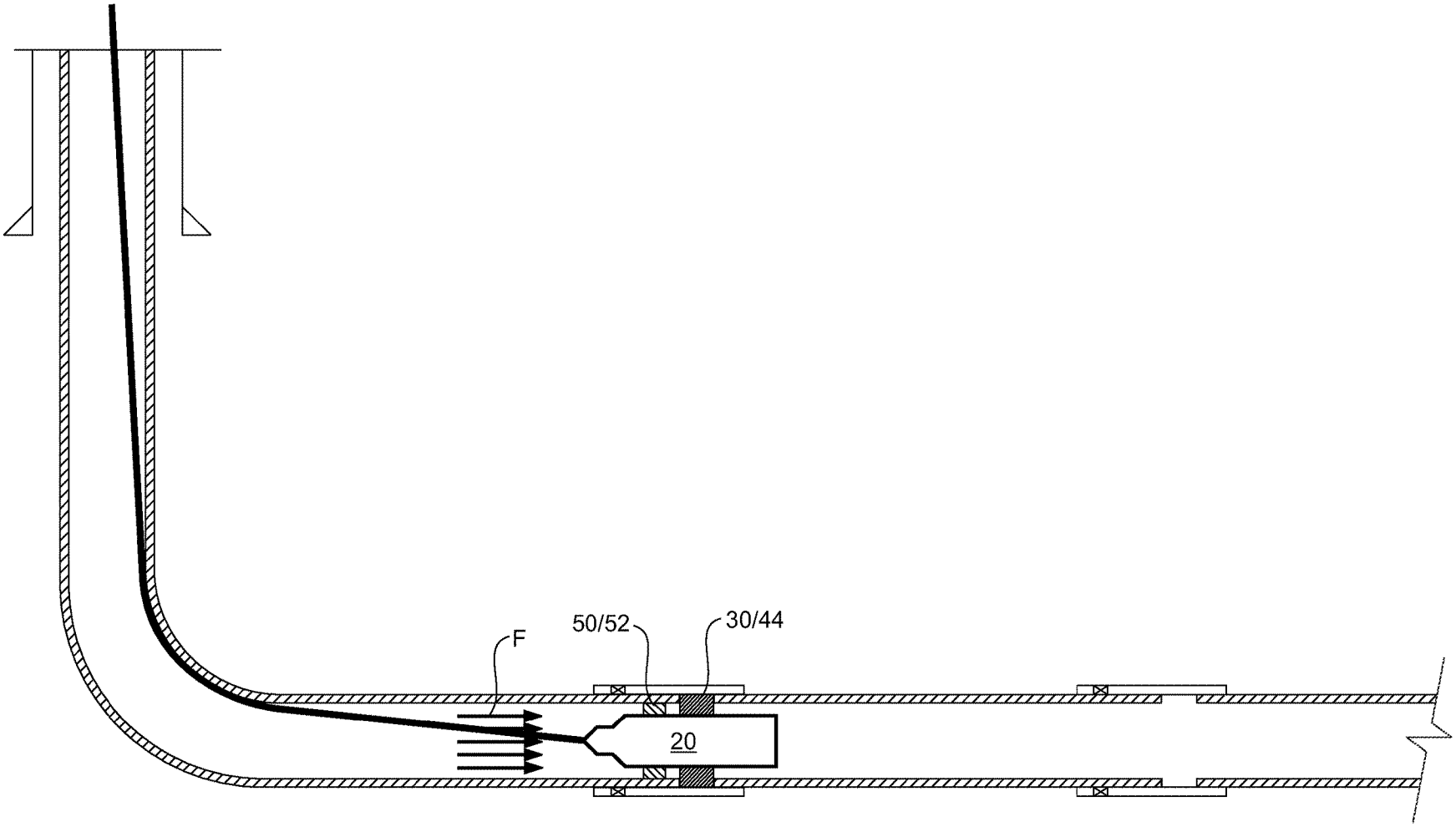
FIG. 4C illustrates the dogs having engaged the recess in the sleeve and an elastomeric sealing element being set in the wellbore to isolate the wellbore annulus, the sleeve valve being opened downhole with the assistance of fluid pumped down the annulus.

Referring to FIGS. 4C and 5C, in embodiments, when the extended dogs 30 have located the sleeve profile 14, the packer element 52 is located below the ports 18 of the sleeve valve 10. In embodiments, as shown in FIG. 4C, the sleeve 12 is of a sufficient length to permit the packer 52 to be set therein. In such circumstances, the packer 52 can be electrically-actuated to sealingly engage the sleeve 12 and act to isolate the wellbore 2 therebelow. In embodiments wherein the sleeve 12 does not have sufficient length to permit the packer 52 to be set therein, such as the embodiment shown in FIG. 5C, the packer 52 can remain partially expanded and set once the sleeve 12 has been shifted to the open position. In embodiments, if desired, the packer 52 can be expanded further without fully setting in the casing 8 to reduce the amount of fluid flow past the partially expanded packer 52 while still allowing the BHA 20 to move axially within the casing 8.

Figure 5D:
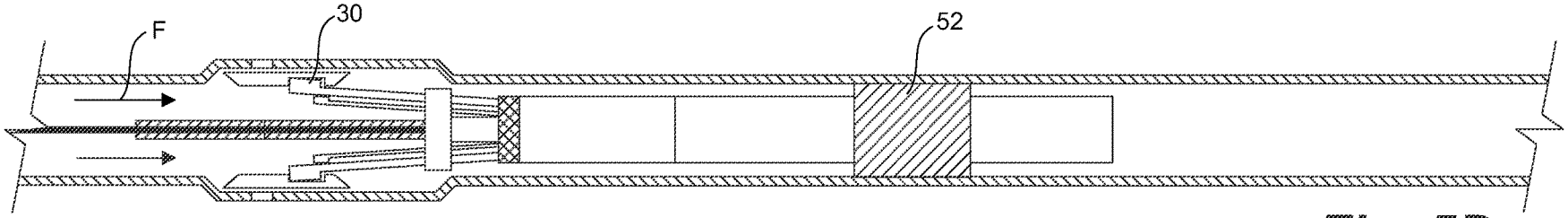

Referring to FIGS. 4C and 5D, the sleeve 12 can be opened utilizing fluid F to push the packer 52 and sleeve 12 downhole and shift the sleeve axially to the open position. The wireline 6 can be slacked appropriately prior to actuating the sleeve 12 downhole to allow the associated movement without straining the wireline 6. In embodiments wherein the packer 52 is configured to be set within the sleeve 12, the packer 52 can be fully set within the sleeve 12 prior to pumping fluid downhole to shift the sleeve 12. In embodiments wherein the packer 52 is configured to be set in the casing 8, the packer 52 may not be expanded fully so as to permit the BHA 20 to move downhole while still creating sufficient pressure differential across the packer 25 to apply the requisite force to shift the sleeve 12.

Figure 5E:
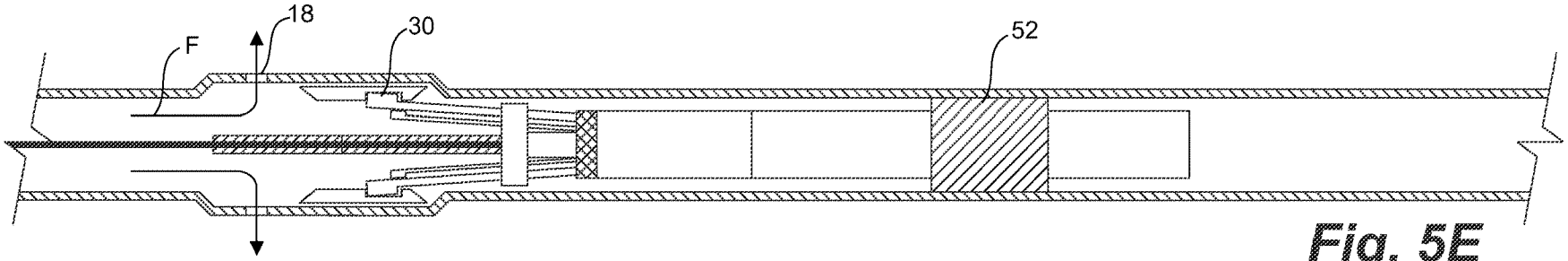

Referring to FIGS. 4D and 5E, the setting of the packer 52 isolates the wellbore 2 below the flow ports 18 of the target sleeve valve 10 such that it is ready for treatment with fracturing fluid F. Fluid F can then be pumped through the now exposed ports 18 of the opened sleeve valve 10 to treat the formation therebeyond. During treatment, moderate tension can be maintained on the wireline 6 to prevent fluid compressing the wireline 6 and causing the formation of birdcages. During fracturing, data from the sensors 26 is provided in real-time to the operator, including pressure, isolation differential pressure and tension or compression on the wireline 6. Other sensor data can be obtained with appropriate sensors 26 incorporated in the instrumentation sub and/or other parts of the BHA 20.

Figure 5F:
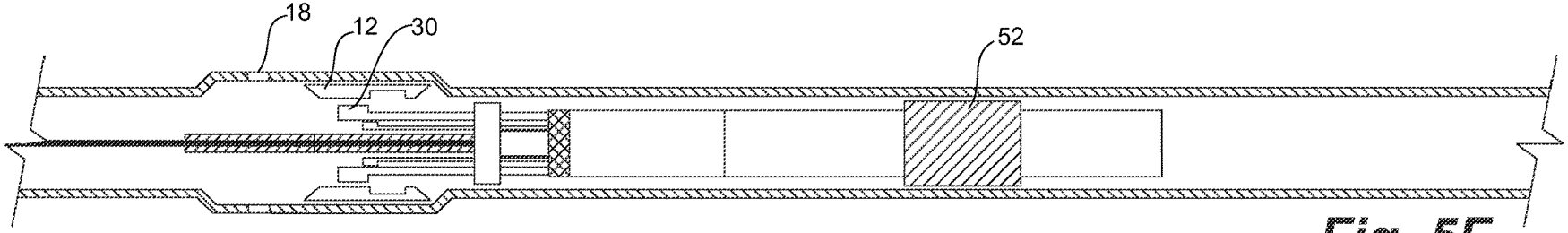
Figure 6A:
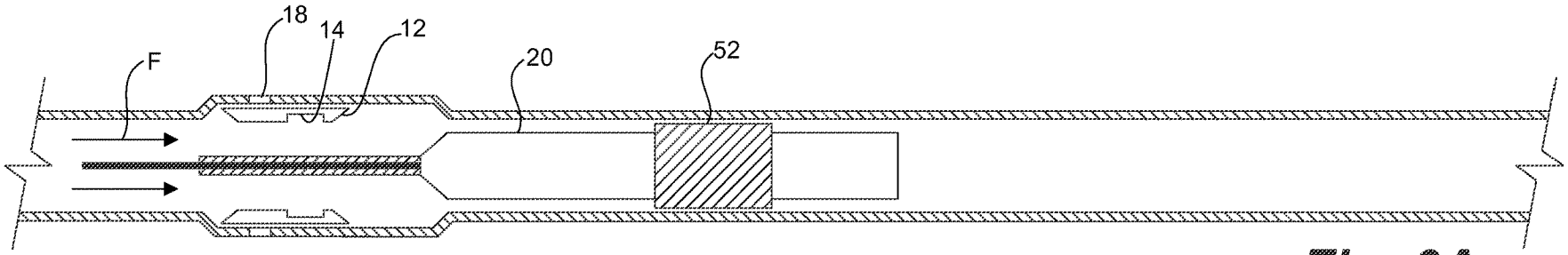
FIGS. 6A to 6F are schematic side views of a portion of a wellbore in a formation, illustrating a sleeve valve and a BHA located thereat, the figures illustrating a sequence of steps to open and treat the target sleeve valve using an embodiment of a BHA having radially-actuable fingers, and more particularly.
Figure 6B:
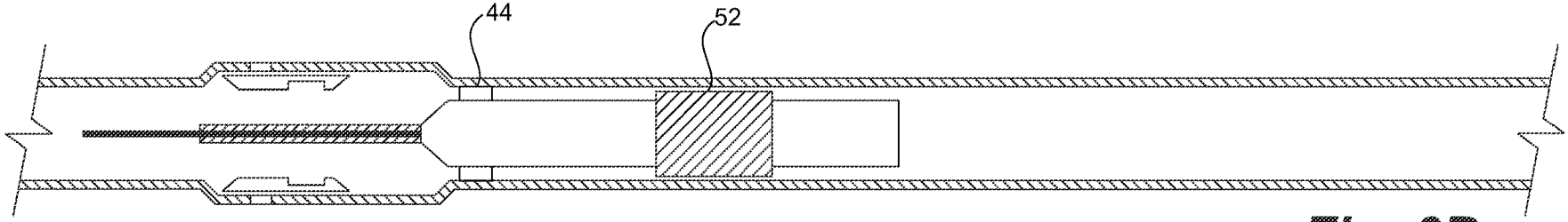
Figure 6C:
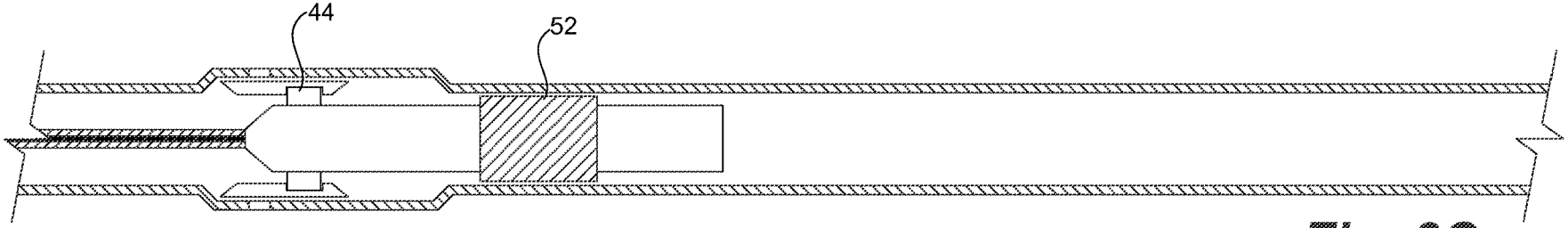
Figure 6D:
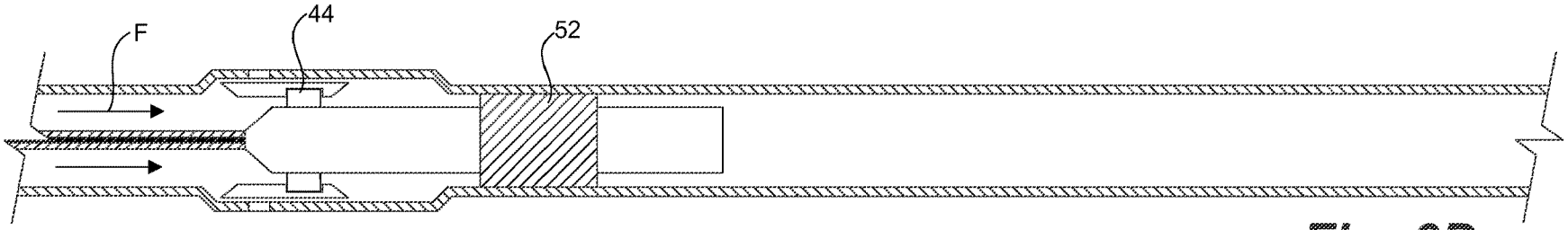
Figure 6E:
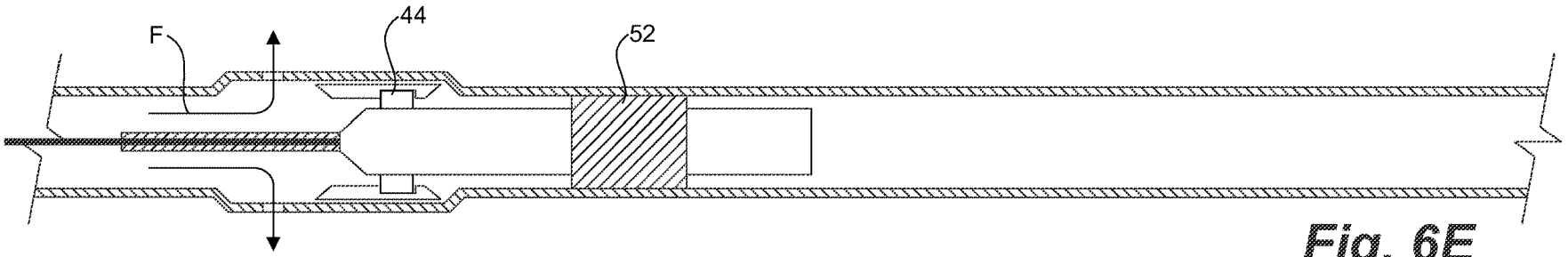
Figure 6F:
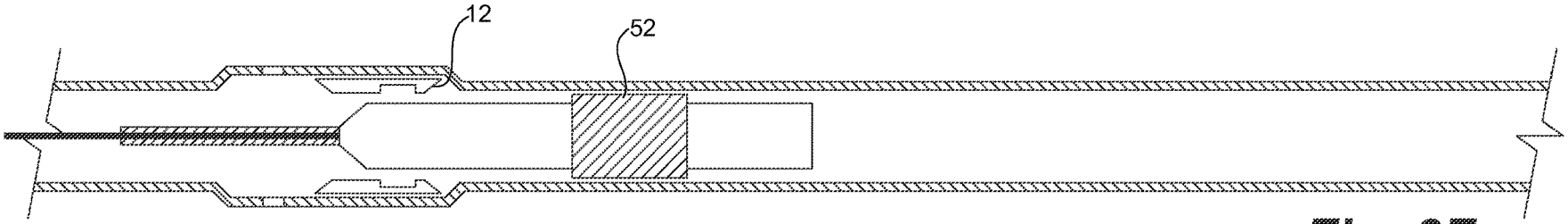

Referring to FIG. 5F, in embodiments, once the treatment of the formation through the target sleeve valve 10 is completed, the packer 52 is deflated and the pressure above and below packer 52 is allowed to equalize. For example, the pressure differential may go from about 1,500 psi to 0 psi. The dogs 30 can remain engaged in the sleeve profile 14 of the sleeve 12 to reduce strain on the wireline 6. Once the pressure has equalized, the dogs 30 are retracted to the RET mode to release the BHA 20 and the wireline 6 can be pulled to locate the BHA 20 to the next target sleeve valve 10 uphole.

With reference to FIGS. 6A-6F, the opening and treatment through a target sleeve valve 10 using a BHA 20 having fingers 44 instead of dogs 30 can be performed in substantially the same manner.

Operation—Dual Action

Referring to FIGS. 4E-4G and 7A-7I, a modified dual action BHA 120 having a stroking mechanism 70 and slip mechanism 60 can be used to both open and close sleeve valves 10.

Figure 7A:
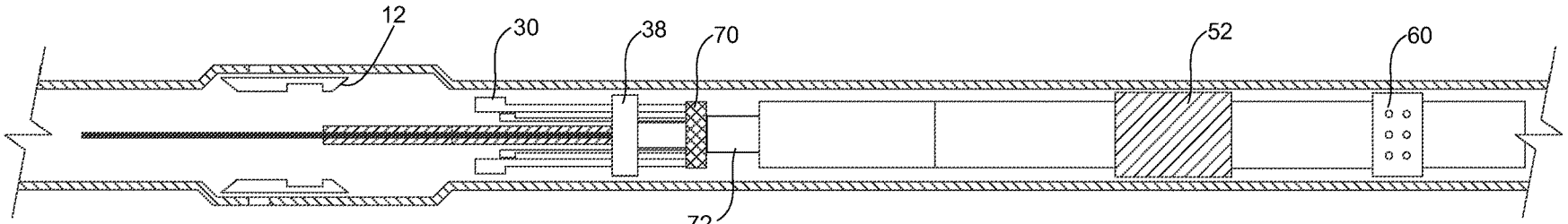

Referring to FIG. 7A, the location of the dual action BHA 120 in the wellbore 2 is performed in a similar manner as with the single action BHA 20 by partially expanding the packer 52 and pumping fluid downhole with the dogs 30/fingers 44 in the radially retracted RET mode.

Figure 4E:
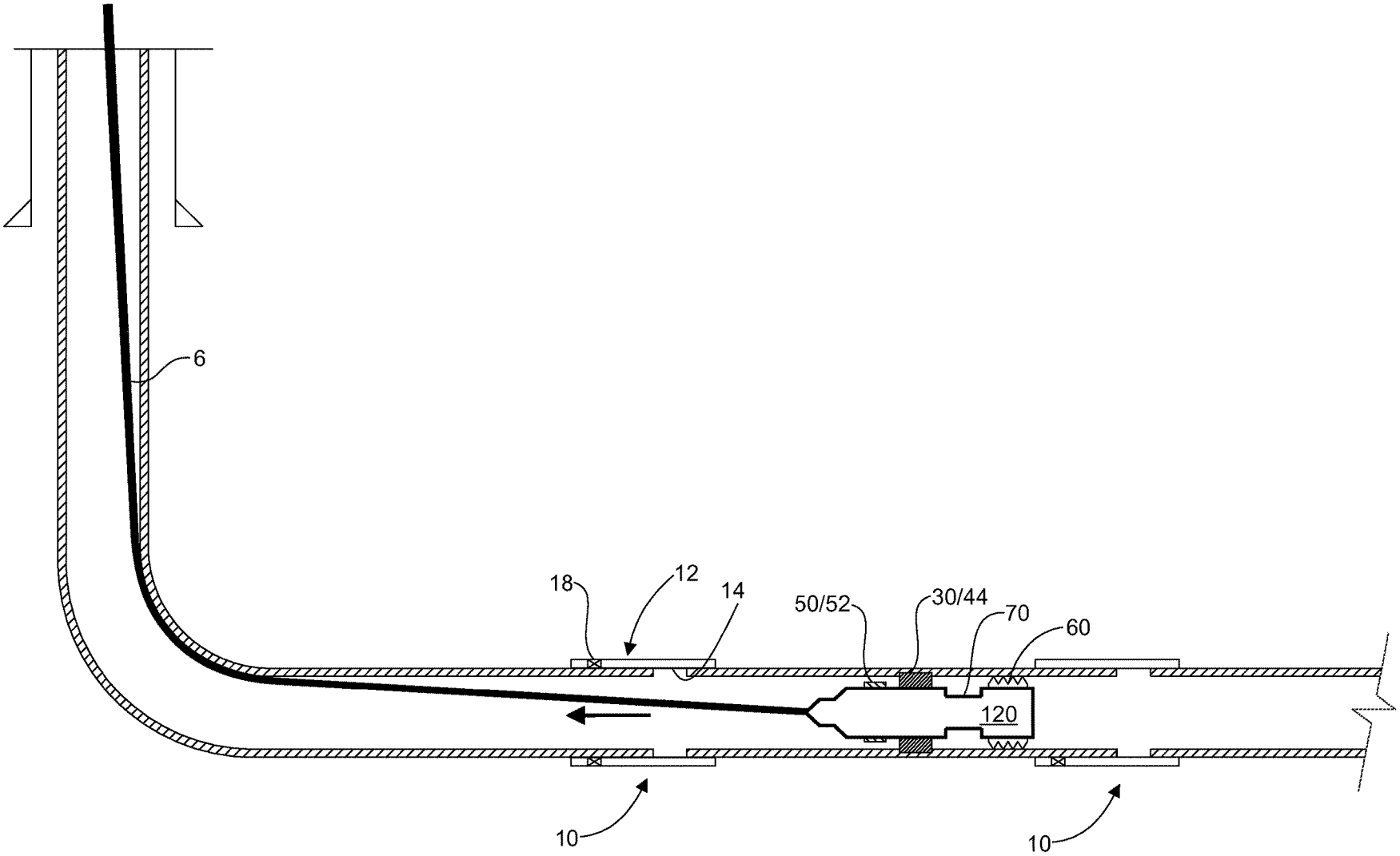
FIGS. 4E to 4G are schematic side views of a wellbore extending to a formation, illustrating an embodiment of an open-close BHA deployed in a wellbore (illustrations and references to the location of sleeves in FIGS. 4E to 4G are fanciful), and more particularly
Figure 7B:
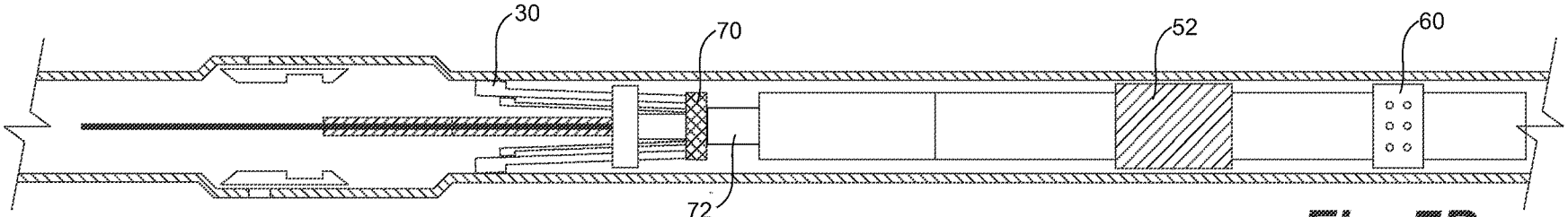

With reference to FIGS. 4E and 7B, with the stroking mechanism 70 in the extended position, the dogs 30/fingers 44 of the BHA 120 can be actuated to the radially outwardly biased LOC mode and the BHA 120 pulled uphole to locate the sleeve profile 14 of the target sleeve valve 10.

Figure 4F:
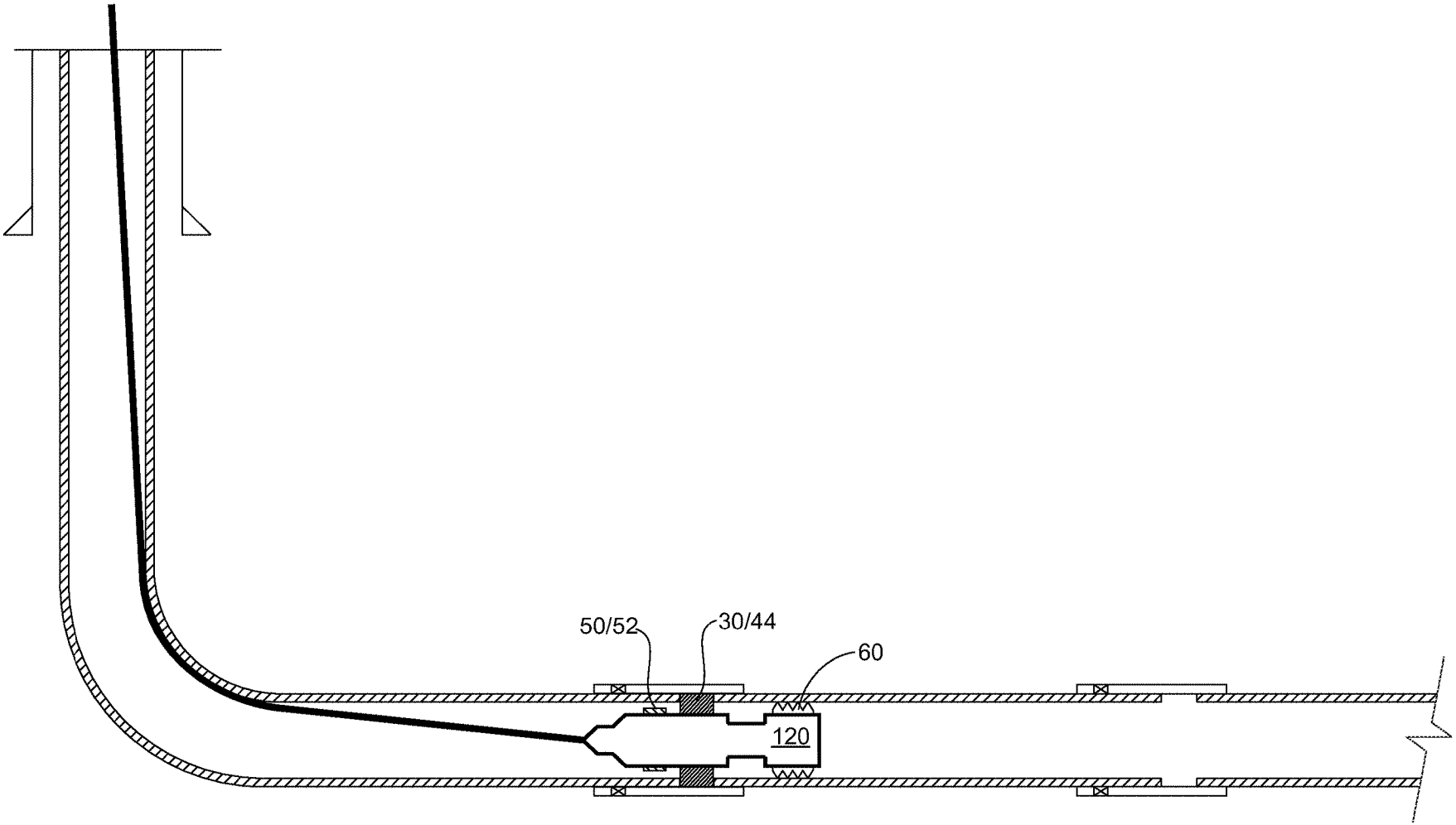
Figure 7C:
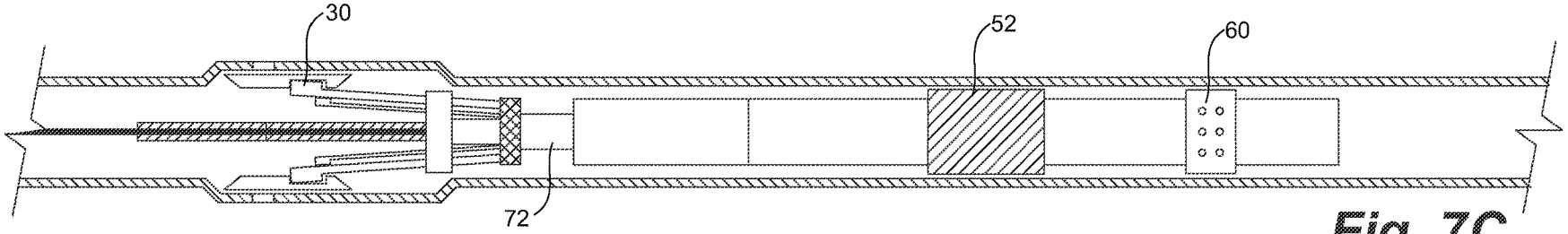

Referring to FIGS. 4F and 7C, once the sleeve profile 14 has been located by the dogs 30/fingers 44, the dogs 30/fingers 44 can be actuated to the SET mode to lock them in the profile 14.

With reference to FIGS. 7Di and 7Ei, in an embodiment, the sleeve 12 can be opened utilizing fluid F to shift the sleeve axially to the open position. Referring to FIG. 7Di, the stroking mechanism 70 can actuated to the retracted position prior to shifting in preparation for use later to close the sleeve 12. The packer 52 can also be set to form a sealing engagement with the sleeve 12 or the casing 8. Referring to FIG. 7Ei, in an embodiment, the sleeve 12 can be opened utilizing fluid F to push the packer 52 and sleeve 12 downhole and shift the sleeve axially to the open position. The wireline 6 can be slacked appropriately prior to actuating the sleeve 12 downhole to allow the associated movement without straining the wireline 6. In embodiments wherein the packer 52 is configured to be set within the sleeve 12, the packer 52 can be fully set within the sleeve 12 prior to pumping fluid downhole to shift the sleeve 12.

With reference to FIGS. 7Dii and 7Eii, in an embodiment, the sleeve 12 can be opened using the stroking mechanism 70. Referring to FIG. 7Dii, the packer 52 can also be set to form a sealing engagement with the sleeve 12 or the casing 8. Referring to FIG. 7Eii, with the dogs 30/fingers 44 in the SET mode, the slip mechanism 60 can be actuated to the engaged position to secure the BHA housing 28 to the casing 8. In an embodiment, the stroking mechanism 70 can be used to open the sleeve. In embodiments, the stroking mechanism 70 can be actuated to the retracted position to move the dogs 30/fingers 44 downhole. As the BHA housing 28 is anchored in the casing 8 with the slip mechanism 60, the sleeve 12 is pulled downhole by the dogs 30/fingers 44 to the open position.

In embodiments wherein the packer 52 is set within the sleeve 12, fluid F can also be pumped downhole to assist the stroking mechanism 70 in actuating the sleeve 12 downhole where the stroking mechanism 70 is configured to be collapsible under fluid F pressure but otherwise extendible using electrical actuation.

Figure 4G:
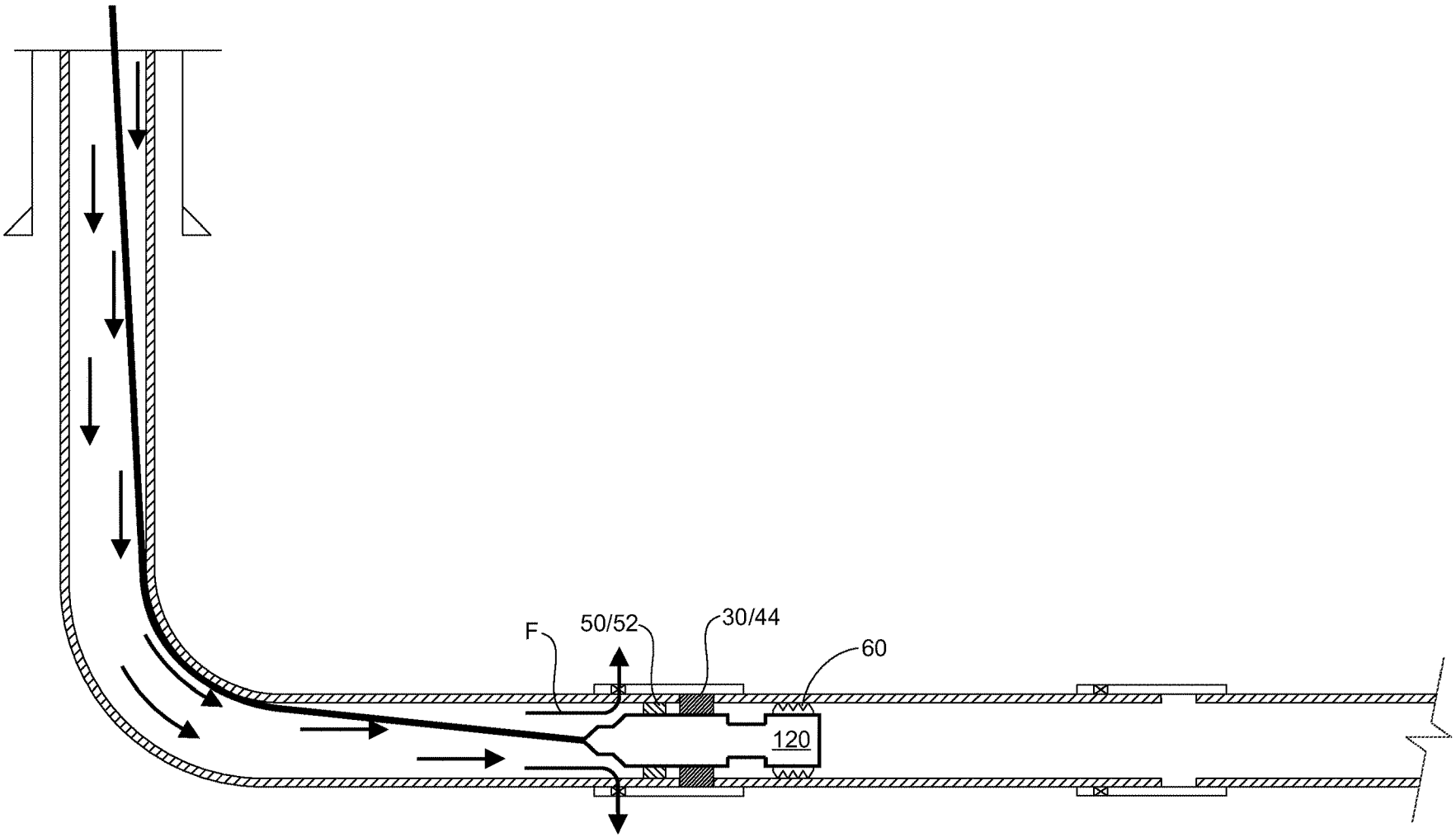
Figure 7F:
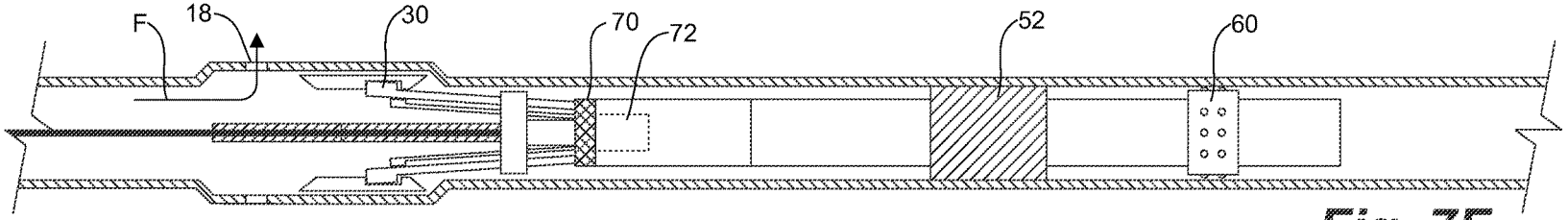
Figure 7G:
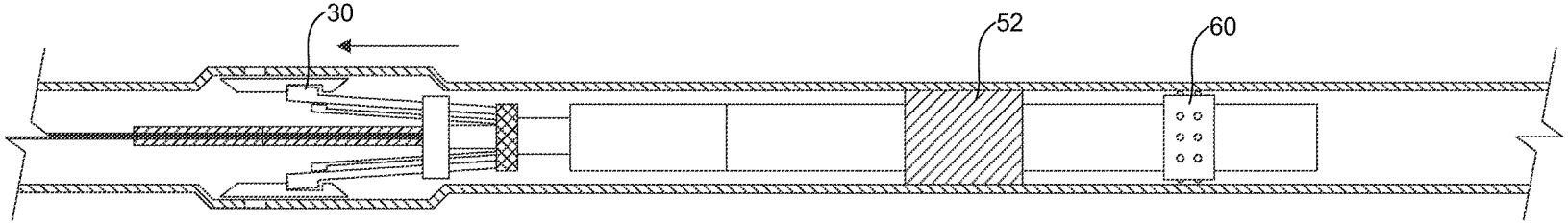

With reference to FIGS. 4G and 7F, the formation can then be treated through the opened sleeve valve 10. If not already engaged, the slip mechanism 60 can be actuated to the engaged position to secure the BHA housing 28 to the casing 8. After treatment is complete, to close the sleeve 12, with reference to FIG. 7G, the stroking mechanism 70 can be actuated back to the extended position with the dogs 30/fingers 44 still engaged in the sleeve profile 14 to push the sleeve 12 uphole to the closed position.

Figure 7H:
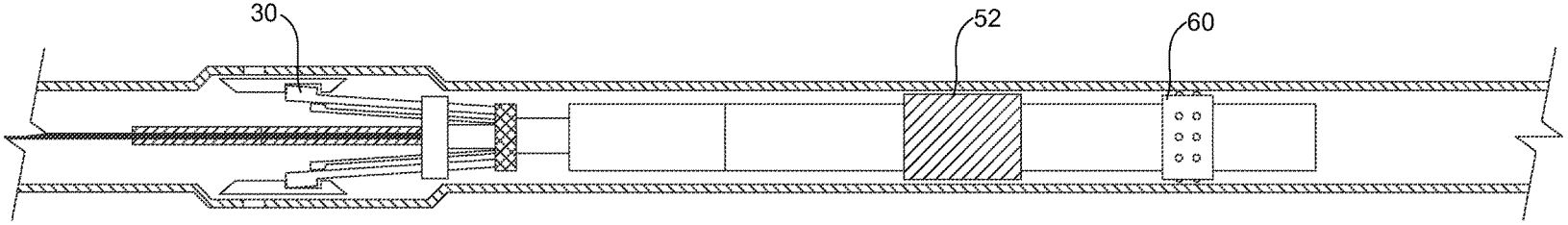
Figure 7I:
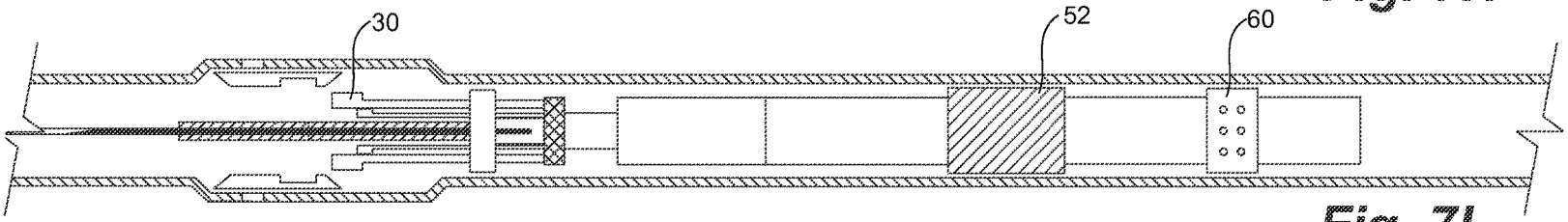
Figure 8A:
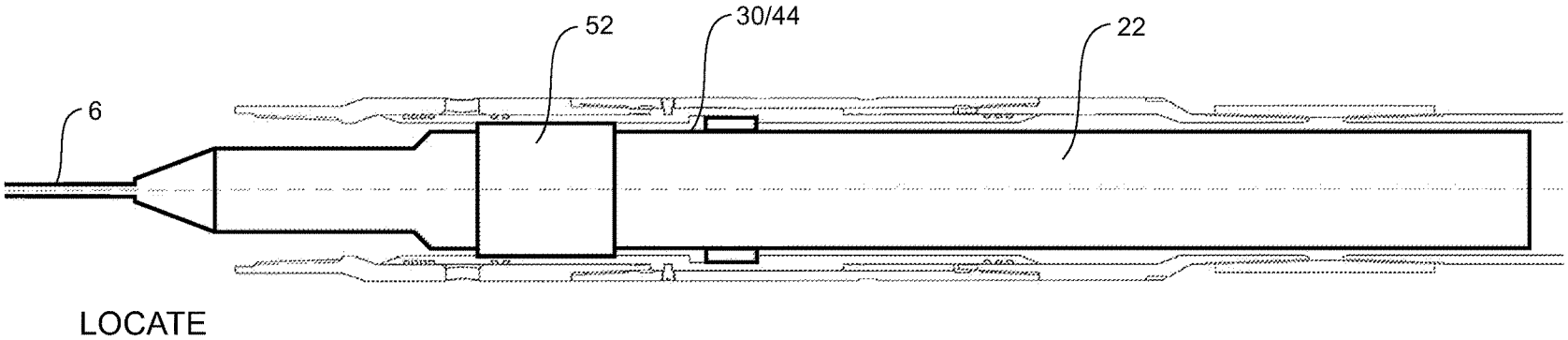
FIGS. 8A and 8B are cross-sectional views of a conventional sleeve valve with a BHA located within and the sleeve engaged by an electrically actuated finger, and the BHA set within the sleeve for opening and hydraulic fracturing treatment through the opened ports.
Figure 8B:
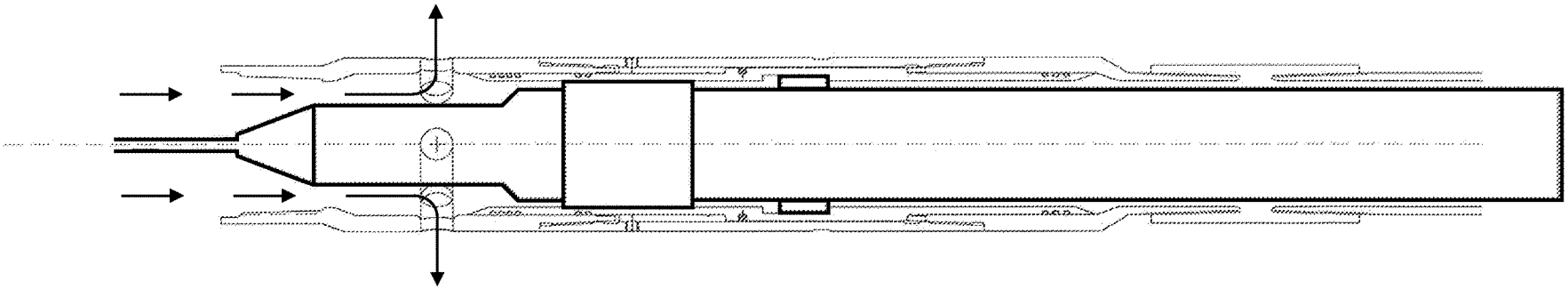

With reference to FIGS. 7H and 7I, after the sleeve 12 has been closed, the packer 52 can be deflated, the dogs 30/fingers 44 actuated to the radially retracted RET mode, and the slip mechanism 60 actuated to the disengaged position, such that the BHA 120 is free to be repositioned downhole of the next target sleeve valve 10.

As the components of the BHA 120 are electrically actuated via instructions form surface communicated through the wireline 6, each of the components can be actuated independently, and in variations of the order as described above, without mechanical cycling of the BHA 120 through various functional modes.

Sensor data provided by the BHA 20/120 in real-time allows the operator to continuously monitor information relating to wireline tension, temperature and pressure in order to ensure that the BHA 20/120 and other equipment is operating under specified conditions. Further, real-time data relating to tension, pressure, temperature and various movement allows the operator to confirm that dogs have been locked or released, slips and packers have been set or released and pressure differentials have been established or allowed to equalize. By being able to confirm that a step has successfully been completed prior initiating the next, the process can be conducted with less chance of error and possible damage to the BHA and other equipment. Additionally, the rate of proppant fluid flow can be controlled to maximize efficacy of the treatment process and reduce chance of excessively wearing or damaging the wireline, BHA and other equipment.

Methods of Use

Figure 9:
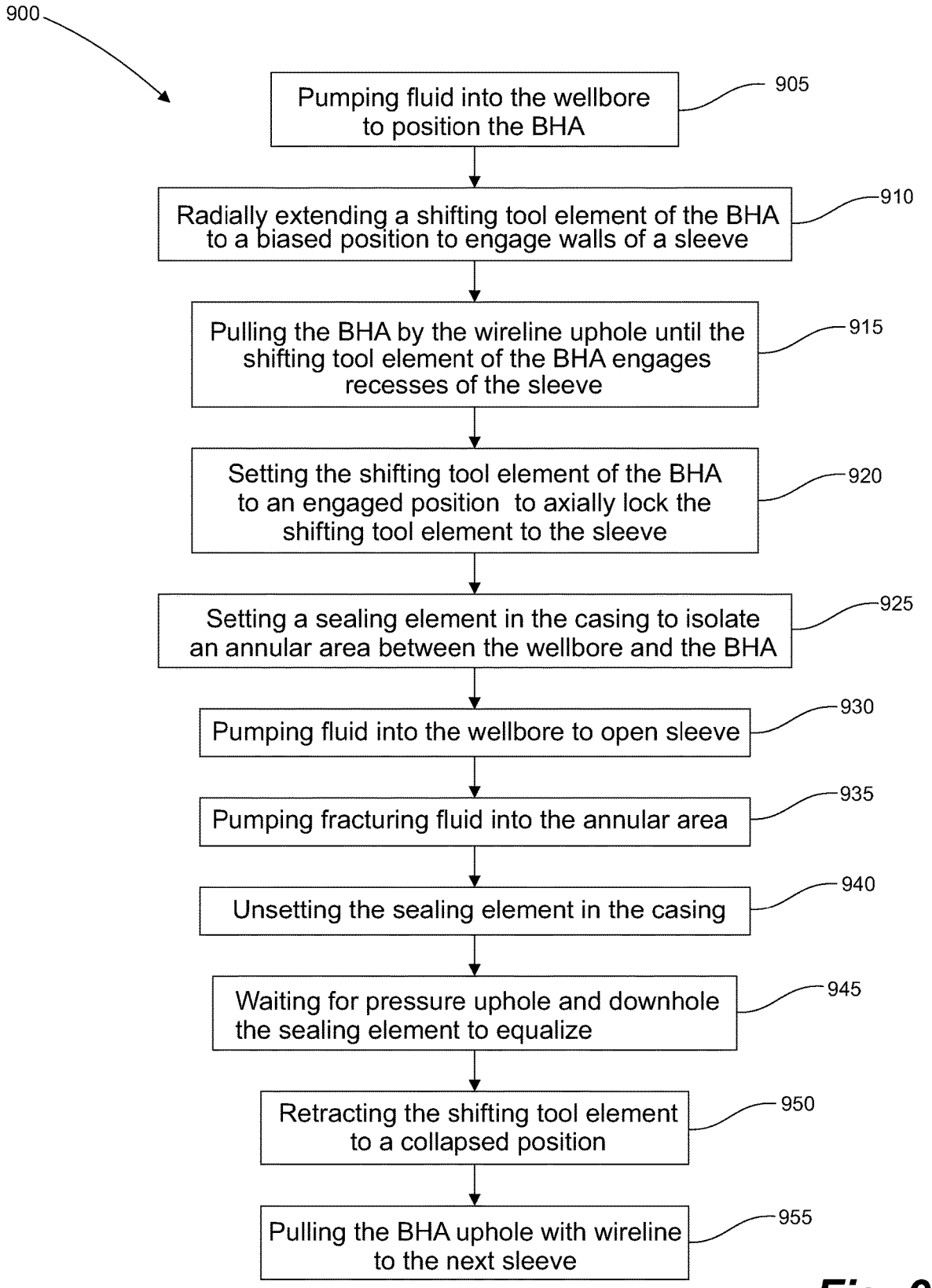
FIG. 9 is a flowchart of an example method of deploying a BHA and opening a sleeve using fluid pressure.

FIG. 9 is a flowchart for example method 900 for deploying a BHA for fracturing operations connected by wireline in a casing of a wellbore. Referring to FIG. 9, at block 905, fluid is pumped fluid into the wellbore to position the BHA. At block 910, a shifting tool element of the BHA is radially extended to a biased position to engage walls of a sleeve. At block 915, the BHA is pulled by the wireline uphole until the shifting tool element of the BHA engages recesses of the sleeve. At block 920, the shifting tool element of the BHA is set to an engaged position to axially lock the shifting tool element to the sleeve. At block 925, a sealing element in the casing is set to isolate an annular area between the wellbore and the BHA. At block 930, fluid is pumped into the wellbore to open the sleeve. At block 935, fracturing fluid is pumped into the annular area. At block 940, the sealing element is unset in the casing. At block 945, wait for pressure uphole and downhole the sealing element to equalize. At block 950, the shifting tool element is retracted to a collapsed position. At block 955, the BHA is pulled uphole with wireline to the next sleeve.

Figure 10:
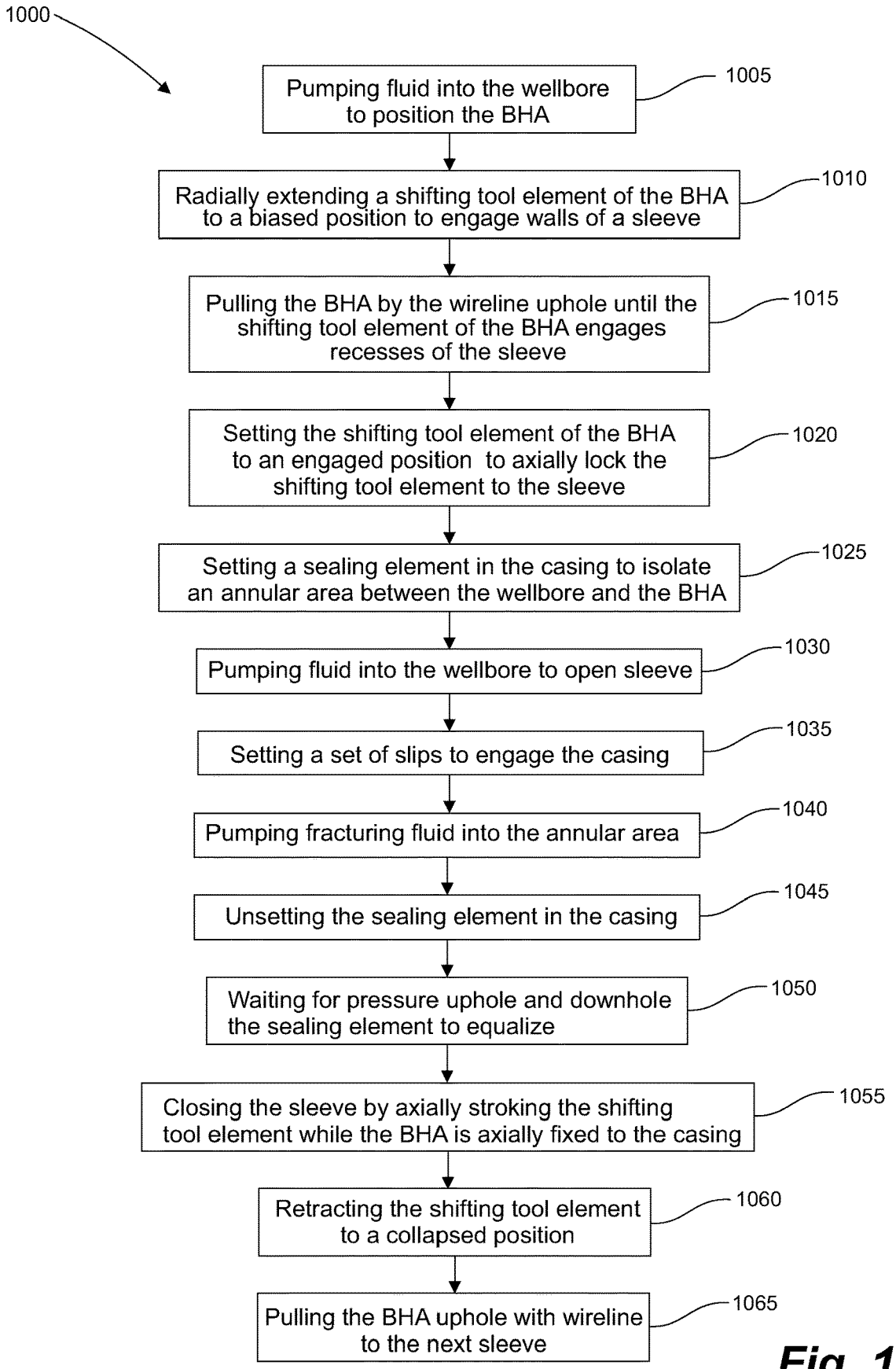
FIG. 10 is a flowchart of an example method of deploying a BHA and opening a sleeve using fluid pressure and stroking the sleeve to close after treatment.

FIG. 10 is a flowchart for example method 900 comprising additional steps for method for 900 of FIG. 9. Referring to FIG. 10, at block 1005, fluid is pumped into the wellbore to position the BHA. At block 1010, a shifting tool element of the BHA is radially extended to a biased position to engage walls of a sleeve. At block 1015, the BHA is pulled by the wireline uphole until the shifting tool element of the BHA engages recesses of the sleeve. At block 1020, the shifting tool element of the BHA is set to an engaged position to axially lock the shifting tool element to the sleeve. At block 1025, a sealing element is set in the casing to isolate an annular area between the wellbore and the BHA. At block 1030, fluid is pumped into the wellbore to open the sleeve. At block 1035, a set of slips is set to engage the casing. At block 1040, fracturing fluid is pumped into the annular area. At block 1045, the sealing element is unset in the casing. At block 1050, wait for pressure uphole and downhole the sealing element to equalize. At block 1055, the sleeve closed by axially stroking the shifting tool element while the BHA is axially fixed to the casing. At block 1060, the shifting tool element is retracted to a collapsed position. At block 1065, the BHA is pulled uphole with wireline to the next sleeve.

Figure 11A:
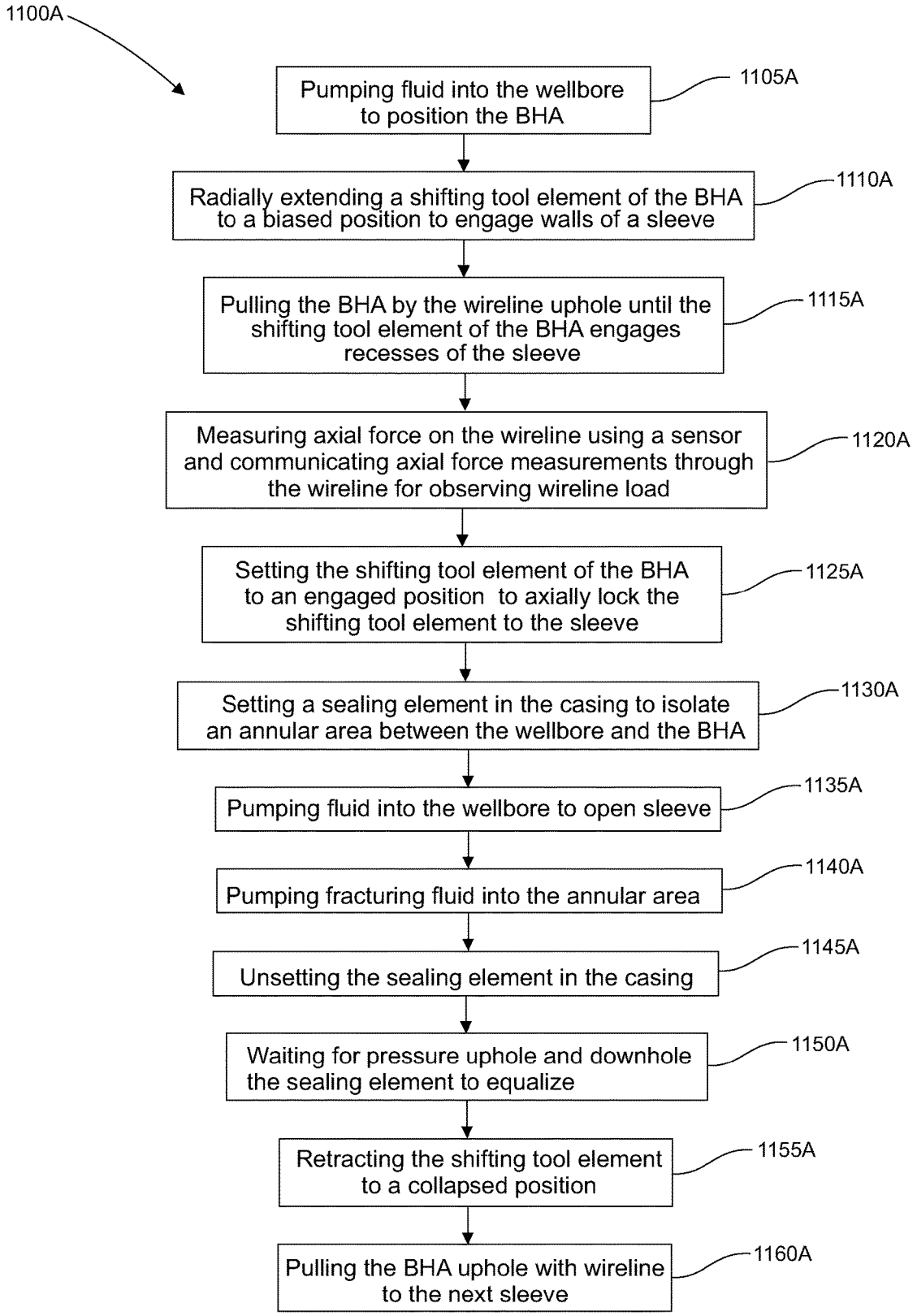
FIGS. 11A to 11E are flowcharts illustrating additional steps of the method of claim 9.

FIG. 11A is a flowchart for example method 900 comprising additional steps for method for 900 of FIG. 9. Referring to FIG. 11A, at block 1105A, fluid is pumped into the wellbore to position the BHA. At block 1110A, a shifting tool element of the BHA is radially extended to a biased position to engage walls of a sleeve. At block 1115A, the BHA is pulled by the wireline uphole until the shifting tool element of the BHA engages recesses of the sleeve. At block 1120A, axial force on the wireline is measured using a sensor and axial force measurements are communicated through the wireline for observing wireline load. At block 1125A, the shifting tool element of the BHA is set to an engaged position to axially lock the shifting tool element to the sleeve. At block 1130A, a sealing element in the casing is set to isolate an annular area between the wellbore and the BHA. At block 1135A, fluid is pumped into the wellbore to open the sleeve. At block 1140A, fracturing fluid is pumped into the annular area. At block 1145A, the sealing element is unset in the casing. At block 1150A, wait for pressure uphole and downhole the sealing element to equalize. At block 1155A, the shifting tool element is retracted to a collapsed position. At block 1160A, the BHA is pulled uphole with wireline to the next sleeve.

Figure 11B:
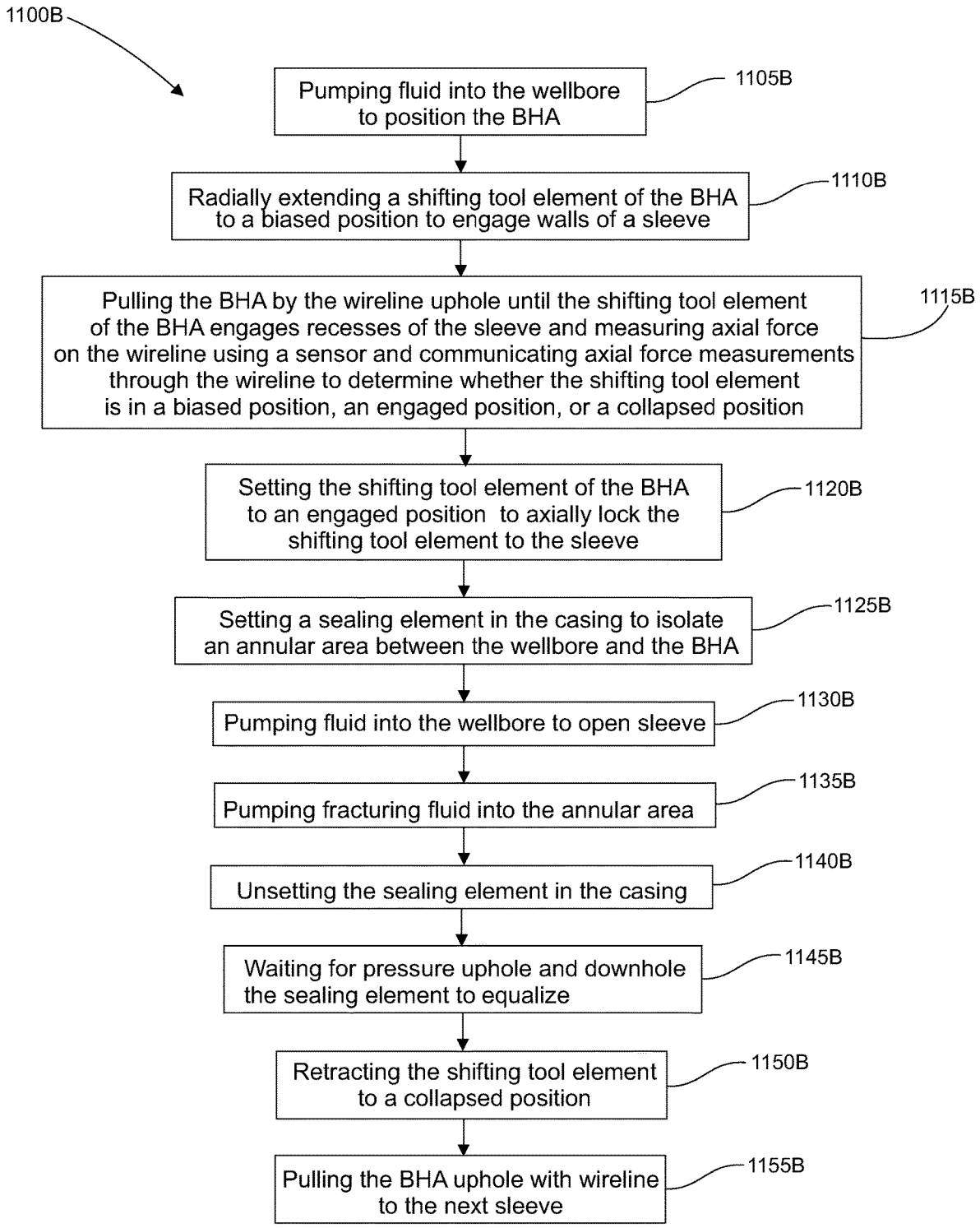

FIG. 11B is a flowchart for example method 900 comprising additional steps for method for 900 of FIG. 9. Referring to FIG. 11B, at block 1105B, fluid is pumped into the wellbore to position the BHA. At block 1110B, a shifting tool element of the BHA is radially extended to a biased position to engage walls of a sleeve. At block 1115B, the BHA is pulled by the wireline uphole until the shifting tool element of the BHA engages recesses of the sleeve and measuring axial force on the wireline using a sensor and communicating axial force measurements through the wireline to determine whether the shifting tool element is in a biased position, an engaged position or a collapsed position. At block 1120B, the shifting tool element of the BHA is set to an engaged position to axially lock the shifting tool element to the sleeve. At block 1125B, a sealing element is set in the casing to isolate an annular area between the wellbore and the BHA. At block 1130B, fluid is pumped into the wellbore to open the sleeve. At block 1135B, fracturing fluid is pumped into the annular area. At block 1140B, the sealing element is unset in the casing. At block 1145B, wait for pressure uphole and downhole the sealing element to equalize. At block 1150B, the shifting tool element is retracted to a collapsed position. At block 1155B, the BHA is pulled uphole with wireline to the next sleeve.

Figure 11C:
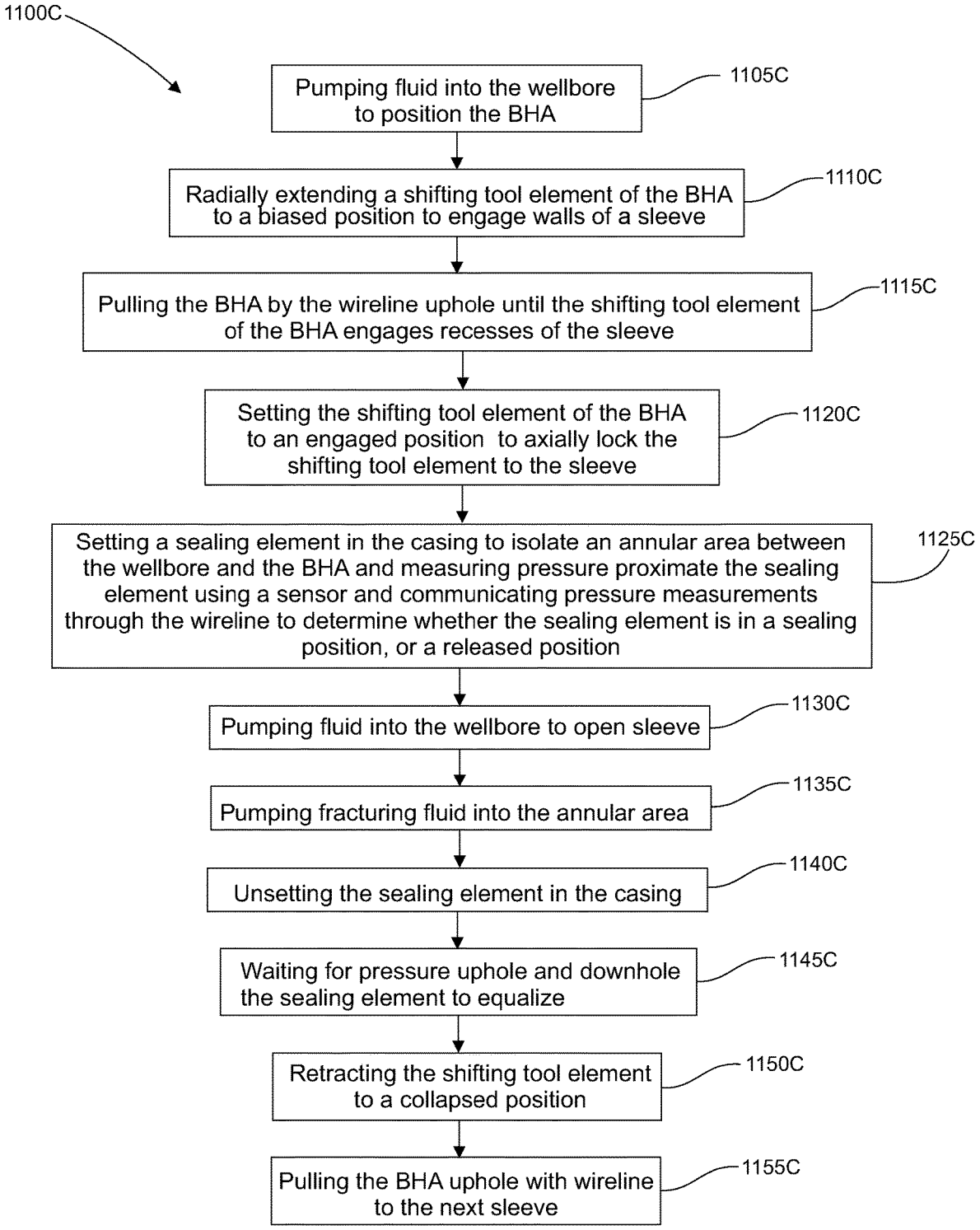

FIG. 11C is a flowchart for example method 900 comprising additional steps for method for 900 of FIG. 9. Referring to FIG. 11C, at block 1105C, fluid is pumped into the wellbore to position the BHA. At block 1110C, a shifting tool element of the BHA is radially extending to a biased position to engage walls of a sleeve. At block 1115C, the BHA is pulled by the wireline uphole until the shifting tool element of the BHA engages recesses of the sleeve. At block 1120C, the shifting tool element of the BHA is set to an engaged position to axially lock the shifting tool element to the sleeve. At block 1125C, a sealing element is set in the casing to isolate an annular area between the wellbore and the BHA and measuring pressure proximate the sealing element using a sensor and communicating pressure measurements through the wireline to determine whether the sealing element is in a sealing position or a released position. At block 1130C, fluid is pumped into the wellbore to open the sleeve. At block 1135C, fracturing fluid is pumped into the annular area. At block 1140C, the sealing element is unset in the casing. At block 1145C, wait for pressure uphole and downhole the sealing element to equalize. At block 1150C, the shifting tool element is retracted to a collapsed position. At block 1155C, the BHA is pulled uphole with wireline to the next sleeve.

Figure 11D:
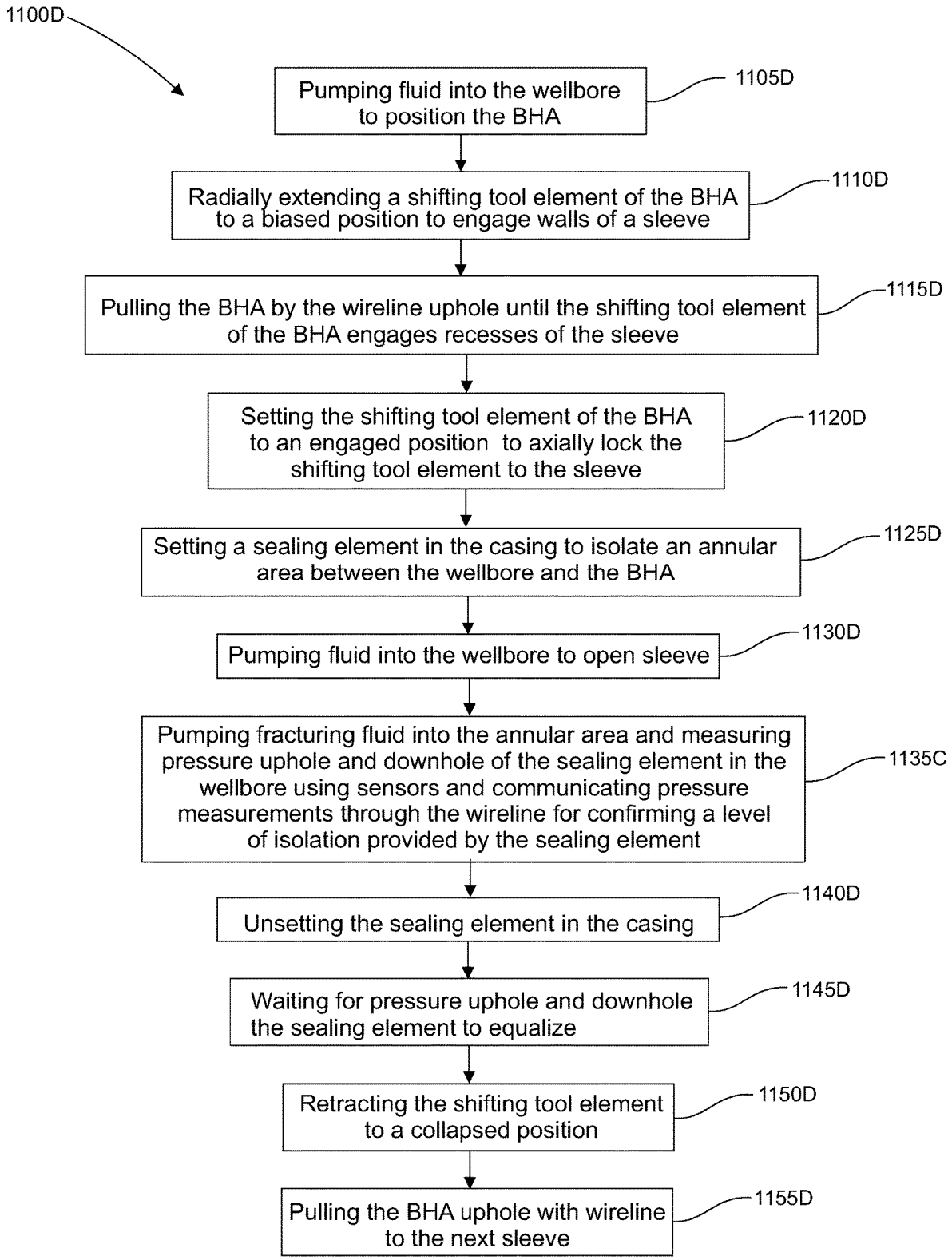

FIG. 11D is a flowchart for example method 900 comprising additional steps for method for 900 of FIG. 9. Referring to FIG. 11D, at block 1105D, fluid is pumped into the wellbore to position the BHA. At block 1110D, a shifting tool element of the BHA is radially extended to a biased position to engage walls of a sleeve. At block 1115D, the BHA is pulled by the wireline uphole until the shifting tool element of the BHA engages recesses of the sleeve. At block 1120D, the shifting tool element of the BHA is set to an engaged position to axially lock the shifting tool element to the sleeve. At block 1125D, a sealing element in the casing is set to isolate an annular area between the wellbore and the BHA. At block 1130D, fluid is pumped into the wellbore to open the sleeve. At block 1135D, fracturing fluid is pumped into the annular area and pressure uphole and downhole of the sealing element in the wellbore is measured using sensors and pressure measurements are communicated through the wireline for confirming a level of isolation provided by the sealing element. At block 1140D, the sealing element is unset in the casing. At block 1145D, wait for pressure uphole and downhole the sealing element to equalize. At block 1150D, the shifting tool element is retracted to a collapsed position. At block 1155D, the BHA is pulled uphole with wireline to the next sleeve.

Figure 11E:
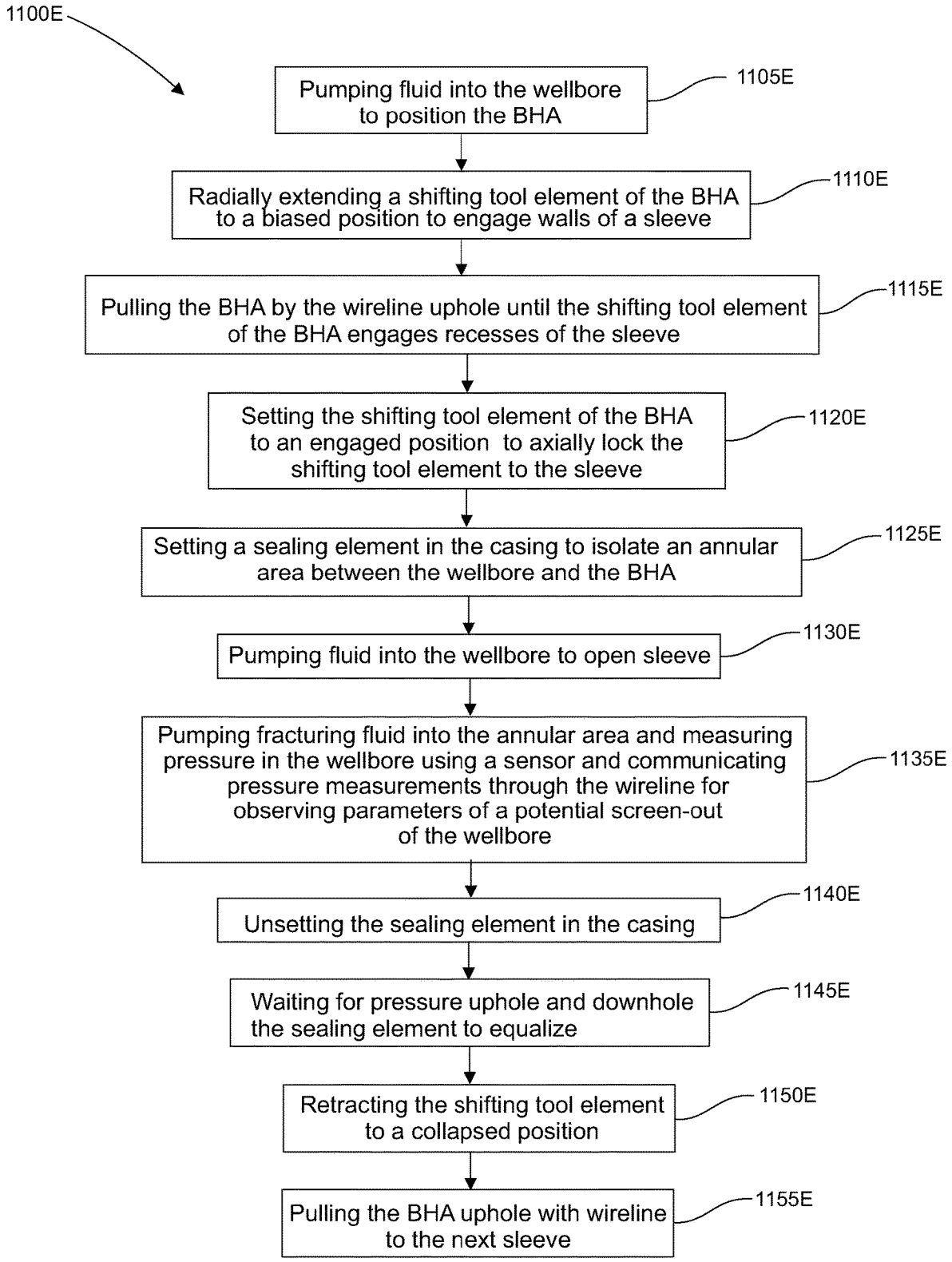

FIG. 11E is a flowchart for example method 900 comprising additional steps for method for 900 of FIG. 9. Referring to FIG. 11E, at block 1105E, pumping fluid into the wellbore to position the BHA. At block 1110E, a shifting tool element of the BHA is radially extended to a biased position to engage walls of a sleeve. At block 1115E, the BHA is pulled by the wireline uphole until the shifting tool element of the BHA engages recesses of the sleeve. At block 1120E, the shifting tool element of the BHA is set to an engaged position to axially lock the shifting tool element to the sleeve. At block 1125E, a sealing element in the casing is set to isolate an annular area between the wellbore and the BHA. At block 1130E, fluid is pumped into the wellbore to open the sleeve. At block 1135E, fracturing fluid is pumped into the annular area and measuring fluid pressure in the wellbore using a sensor and communicating pressure measurements through the wireline for observing parameters of a potential screen-out of the wellbore. At block 1140E, the sealing element is unset in the casing. At block 1145E, wait for pressure uphole and downhole the sealing element to equalize. At block 1150E, the shifting tool element is retracted to a collapsed position. At block 1155E, the BHA is pulled uphole with wireline to the next sleeve.

Figure 12:
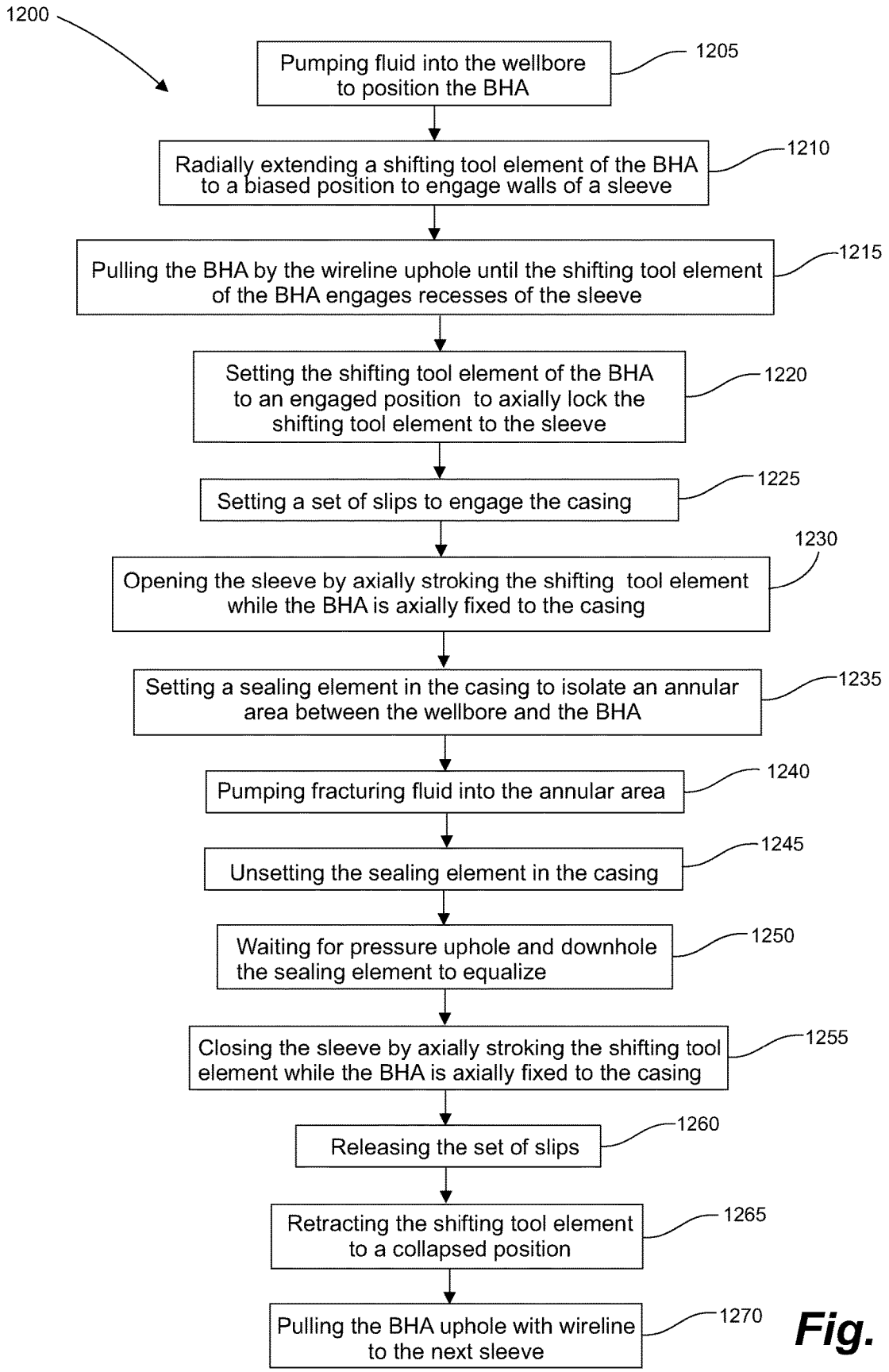
FIG. 12 is a flowchart of an example method of deploying a BHA and stroking a sleeve to open and close.

FIG. 12 is a flowchart for example method 1200 for deploying a BHA for fracturing operations connected by wireline in a casing of a wellbore. Referring to FIG. 12, at block 1205, fluid is pumped into the wellbore to position the BHA. At block 1210, a shifting tool element of the BHA is radially extended to a biased position to engage walls of a sleeve. At block 1215, the BHA is pulled by the wireline uphole until the shifting tool element of the BHA engages recesses of the sleeve. At block 1220, the shifting tool element of the BHA is set to an engaged position to axially lock the shifting tool element to the sleeve. At block 1225, a set of slips is set to engage the casing. At block 1230, sleeve is opened by axially stroking the shifting tool element while the BHA is axially fixed to the casing. At block 1235, a sealing element in the casing is set to isolate an annular area between the wellbore and the BHA. At block 1240, fracturing fluid is pumped into the annular area. At block 1245, the sealing element in the casing is unset. At block 1250, wait for pressure uphole and downhole the sealing element to equalize. At block 1255, the sleeve is closed by axially stroking the shifting tool element while the BHA is axially fixed to the casing. At block 1260, the set of slips is released. At block 1265, the shifting tool element is retracted to a collapsed position. At block 1270, the BHA is pulled uphole with wireline to the next sleeve.

Figure 13A:
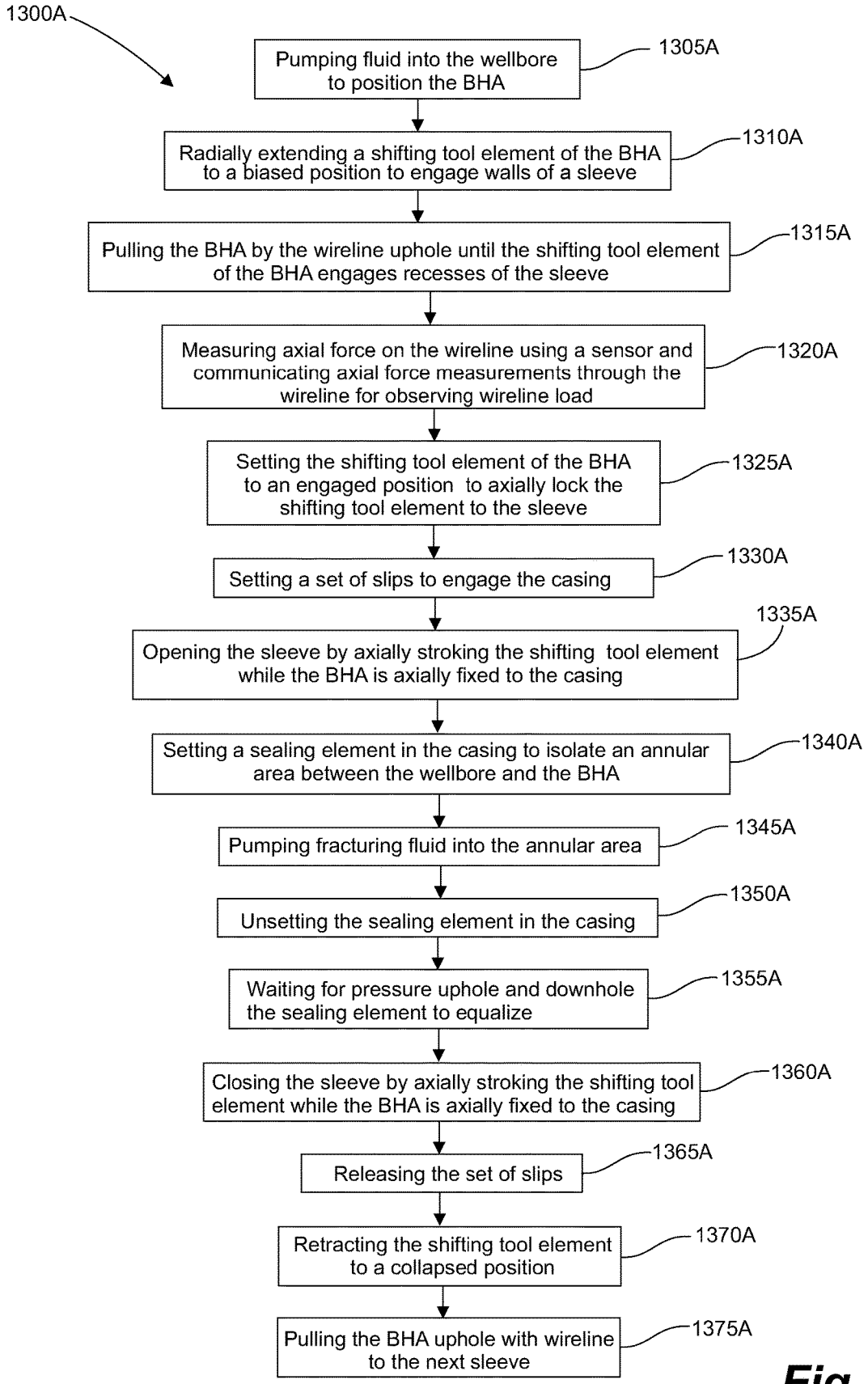
FIGS. 13A to 13E are flowcharts illustrating additional steps of the method of claim 15.

FIG. 13A is a flowchart for example method 900 comprising additional steps for method for 1200 of FIG. 12. Referring to FIG. 13A, at block 1305A, fluid is pumped into the wellbore to position the BHA. At block 1310A, a shifting tool element of the BHA is radially extended to a biased position to engage walls of a sleeve. At block 1315A, the BHA is pulled by the wireline uphole until the shifting tool element of the BHA engages recesses of the sleeve. At block 1320A, axial force on the wireline is measured using a sensor and axial force measurements are communicated through the wireline for observing wireline load. At block 1325A, the shifting tool element of the BHA is set to an engaged position to axially lock the shifting tool element to the sleeve. At block 1330A, a set of slips is set to engage the casing. At block 1335A, the sleeve is opened by axially stroking the shifting tool element while the BHA is axially fixed to the casing. At block 1340A, a sealing element in the casing is set to isolate an annular area between the wellbore and the BHA. At block 1345A, fracturing fluid is pumped into the annular area. At block 1350A, the sealing element is unset in the casing. At block 1355A, wait for pressure uphole and downhole the sealing element to equalize. At block 1360A, the sleeve is closed by axially stroking the shifting tool element while the BHA is axially fixed to the casing. At block 1365A, the set of slips is released. At block 1370A, the shifting tool element is retracted to a collapsed position. At block 1375A, the BHA is pulled uphole with wireline to the next sleeve.

Figure 13B:
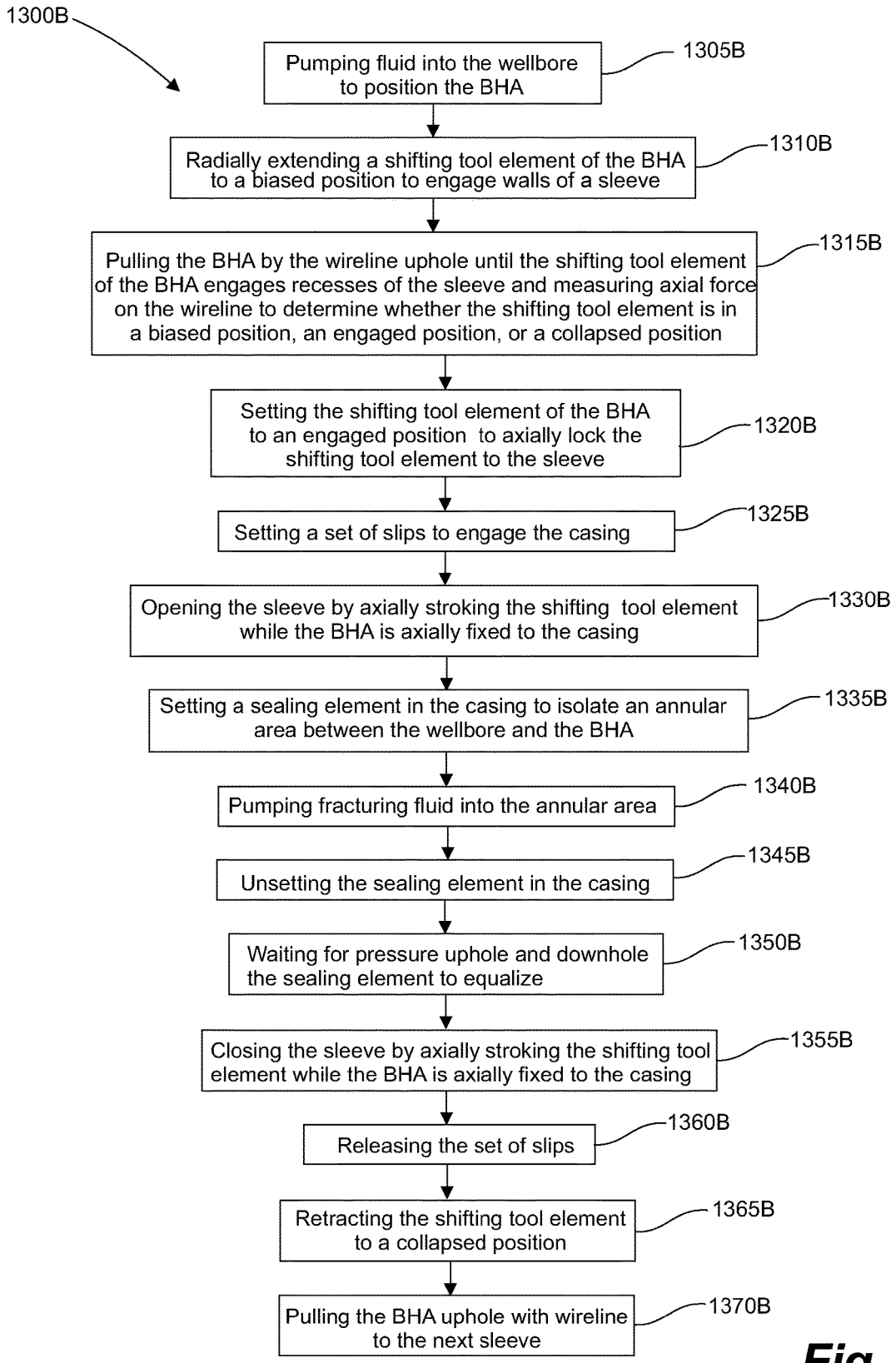

FIG. 13B is a flowchart for example method 900 comprising additional steps for method for 1200 of FIG. 12. Referring to FIG. 13B, at block 1305B, fluid is pumped into the wellbore to position the BHA. At block 1310B, a shifting tool element of the BHA is radially extended to a biased position to engage walls of a sleeve. At block 1315B, the BHA is pulled by the wireline uphole until the shifting tool element of the BHA engages recesses of the sleeve and axial force on the wireline is measured using a sensor and axial force measurements are communicated through the wireline to determine whether the shifting tool element is in a biased position, an engaged position or a collapsed position. At block 1320B, the shifting tool element of the BHA is set to an engaged position to axially lock the shifting tool element to the sleeve. At block 1325B, a set of slips is set to engage the casing. At block 1330B, the sleeve is opened by axially stroking the shifting tool element while the BHA is axially fixed to the casing. At block 1335B, a sealing element in the casing is set to isolate an annular area between the wellbore and the BHA. At block 1340B, fracturing fluid is pumped into the annular area. At block 1345B, the sealing element is unset in the casing. At block 1350B, wait for pressure uphole and downhole the sealing element to equalize. At block 1355B, the sleeve is closed by axially stroking the shifting tool element while the BHA is axially fixed to the casing. At block 1360B, the set of slips is released. At block 1365B, the shifting tool element is retracted to a collapsed position. At block 1370B, the BHA is pulled uphole with wireline to the next sleeve.

Figure 13C:
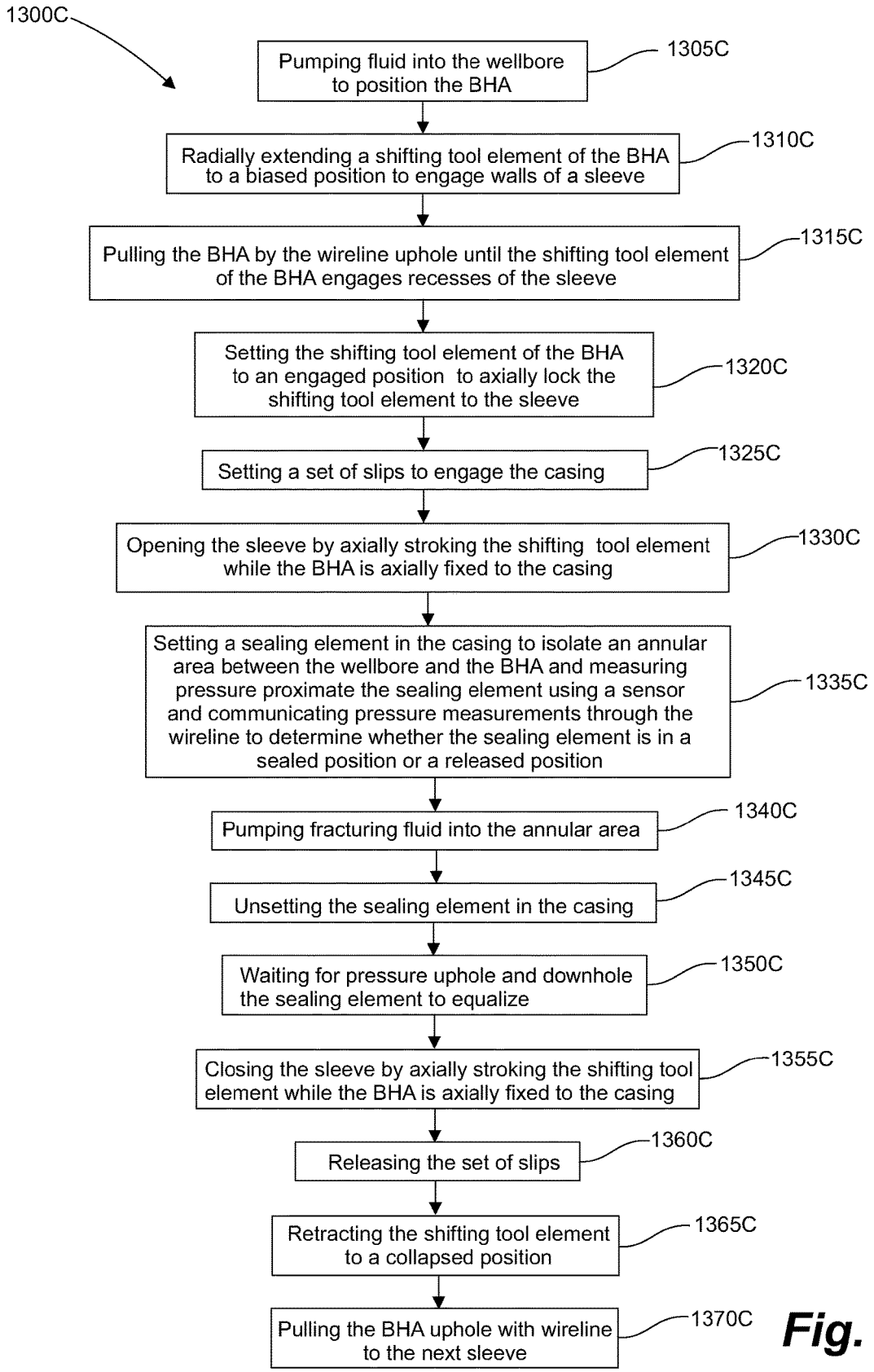

FIG. 13C is a flowchart for example method 900 comprising additional steps for method for 1200 of FIG. 12. Referring to FIG. 13C, at block 1305C, fluid is pumped into the wellbore to position the BHA. At block 1310C, a shifting tool element of the BHA is radially extended to a biased position to engage walls of a sleeve. At block 1315C, the BHA is pulled by the wireline uphole until the shifting tool element of the BHA engages recesses of the sleeve. At block 1320C, the shifting tool element of the BHA is set to an engaged position to axially lock the shifting tool element to the sleeve. At block 1325C, a set of slips is set to engage the casing. At block 1330C, the sleeve is opened by axially stroking the shifting tool element while the BHA is axially fixed to the casing. At block 1335C, a sealing element in the casing is set to isolate an annular area between the wellbore and the BHA and pressure proximate the sealing element is measured using a sensor and pressure measurements are communicated through the wireline to determine whether the sealing element is in a sealing position or a released position. At block 1340C, fracturing fluid is pumped into the annular area. At block 1345C, the sealing element is unset in the casing. At block 1350C, wait for pressure uphole and downhole the sealing element to equalize. At block 1355C, the sleeve is closed by axially stroking the shifting tool element while the BHA is axially fixed to the casing. At block 1360C, the set of slips is released. At block 1365C, the shifting tool element is retracted to a collapsed position. At block 1370C, the BHA is pulled uphole with wireline to the next sleeve.

Figure 13D:
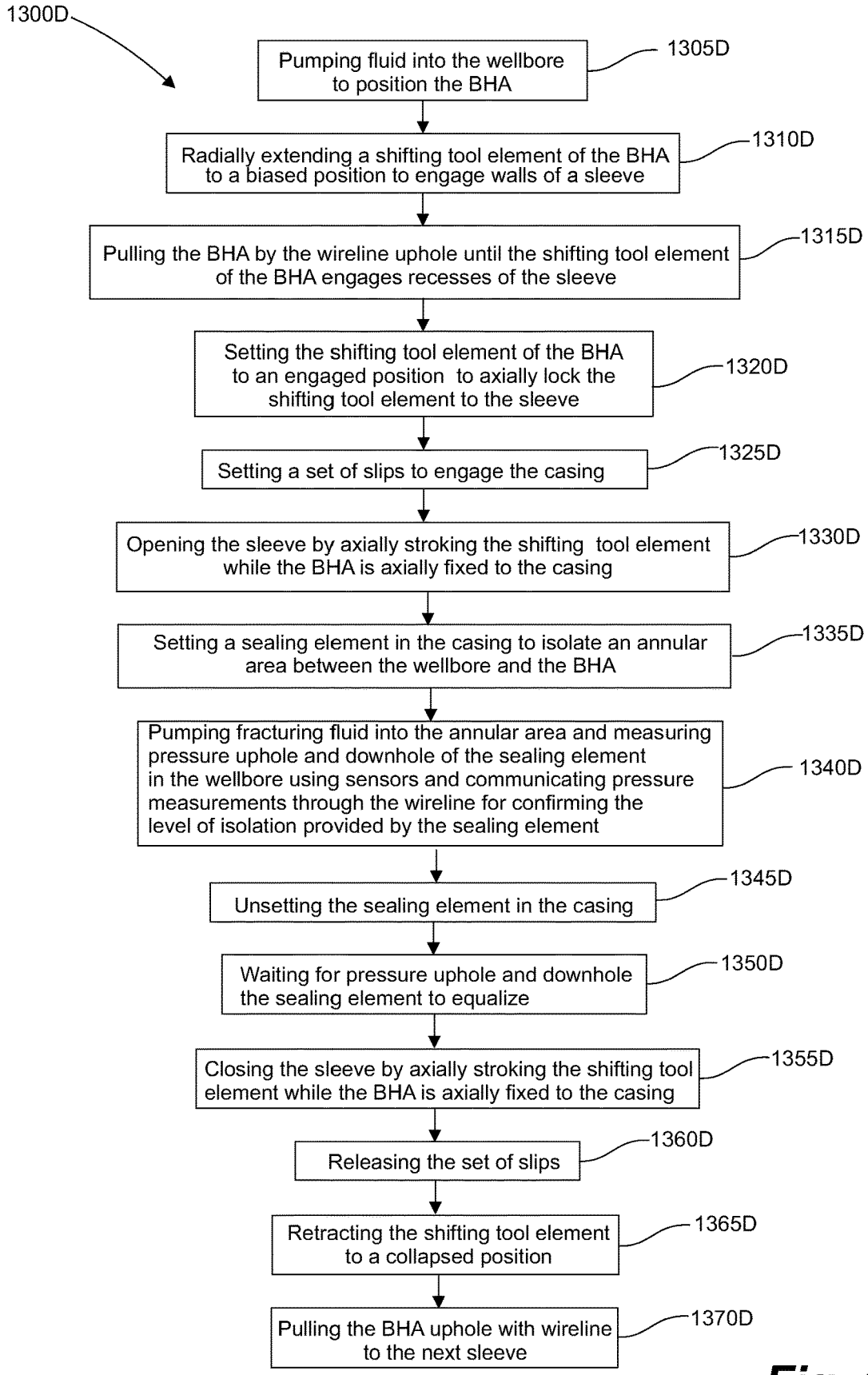

FIG. 13D is a flowchart for example method 900 comprising additional steps for method for 1200 of FIG. 12. Referring to FIG. 13D, at block 1305D, fluid is pumped into the wellbore to position the BHA. At block 1310D, a shifting tool element of the BHA is radially extended to a biased position to engage walls of a sleeve. At block 1315D, the BHA is pulled by the wireline uphole until the shifting tool element of the BHA engages recesses of the sleeve. At block 1320D, the shifting tool element of the BHA is set to an engaged position to axially lock the shifting tool element to the sleeve. At block 1325D, a set of slips is set to engage the casing. At block 1330D, the sleeve is opened by axially stroking the shifting tool element while the BHA is axially fixed to the casing. At block 1335D, a sealing element in the casing is set to isolate an annular area between the wellbore and the BHA. At block 1340D, fracturing fluid is pumped into the annular area and pressure uphole and downhole of the sealing element in the wellbore is measured using sensors and pressure measurements are communicated through the wireline for confirming a level of isolation provided by the sealing element. At block 1345D, the sealing element is unset in the casing. At block 1350D, wait for pressure uphole and downhole the sealing element to equalize. At block 1355D, the sleeve is closed by axially stroking the shifting tool element while the BHA is axially fixed to the casing. At block 1360D, the set of slips is released. At block 1365D, the shifting tool element is retracted to a collapsed position. At block 1370D, the BHA is pulled uphole with wireline to the next sleeve.

Figure 13E:
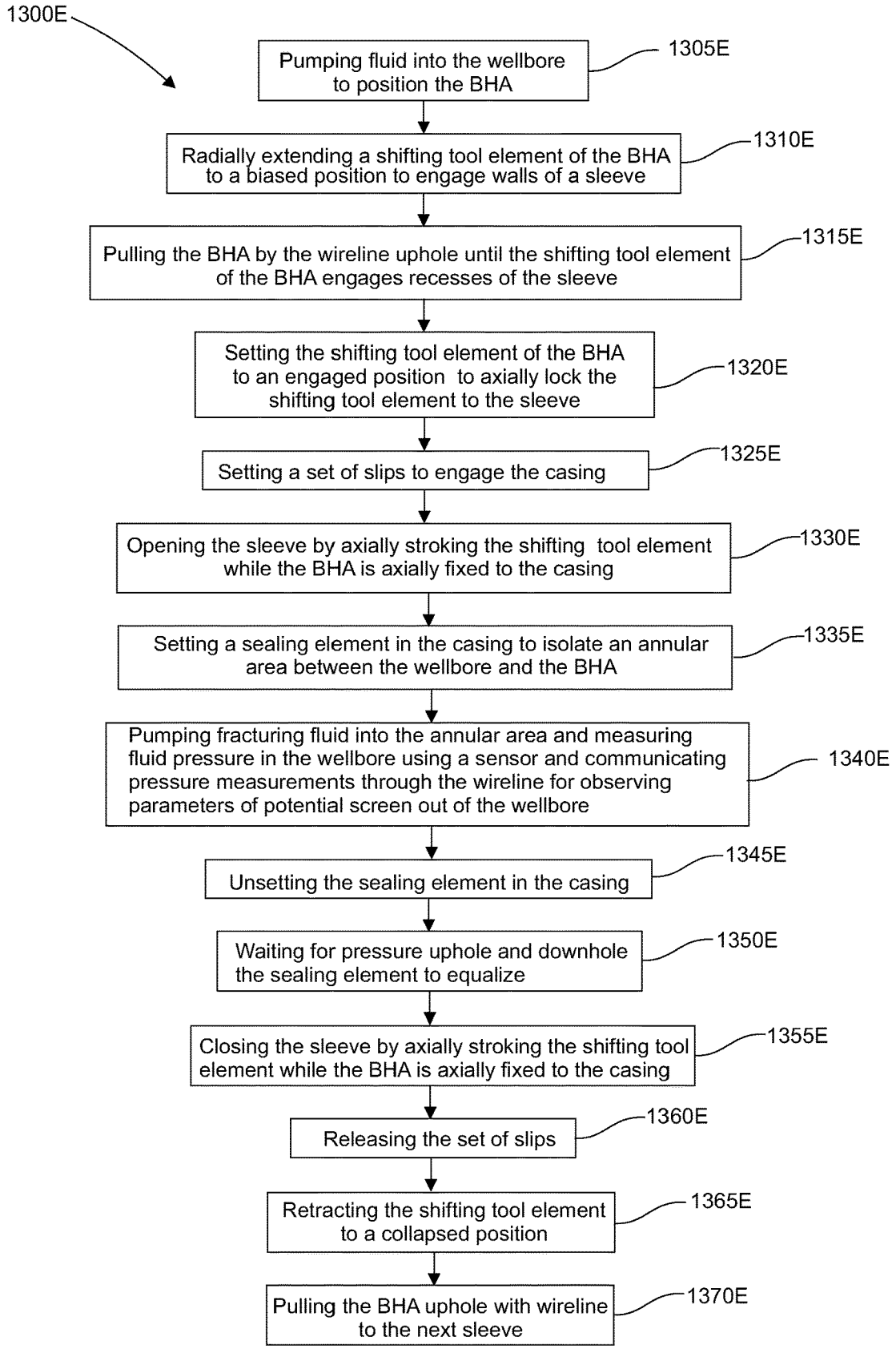

FIG. 13E is a flowchart for example method 900 comprising additional steps for method for 1200 of FIG. 12. Referring to FIG. 13E, at block 1305E, fluid is pumped into the wellbore to position the BHA. At block 1310E, a shifting tool is radially extended element of the BHA to a biased position to engage walls of a sleeve. At block 1315E, the BHA is pulled by the wireline uphole until the shifting tool element of the BHA engages recesses of the sleeve. At block 1320E, the shifting tool element of the BHA is set to an engaged position to axially lock the shifting tool element to the sleeve. At block 1325E, a set of slips is set to engage the casing. At block 1330E, the sleeve is opened by axially stroking the shifting tool element while the BHA is axially fixed to the casing. At block 1335E, a sealing element is set in the casing to isolate an annular area between the wellbore and the BHA. At block 1340E, fracturing fluid is pumped into the annular area and measuring fluid pressure in the wellbore using a sensor and communicating pressure measurements through the wireline for observing parameters of a potential screen-out of the wellbore. At block 1345E, the sealing element is unset in the casing. At block 1350E, wait for pressure uphole and downhole the sealing element to equalize. At block 1355E, the sleeve is closed by axially stroking the shifting tool element while the BHA is axially fixed to the casing. At block 1360E, the set of slips is released. At block 1365E, the shifting tool element is retracted to a collapsed position. At block 1370E, the BHA is pulled uphole with wireline to the next sleeve.

Although a few embodiments have been shown and described, it will be appreciated by those skilled in the art that various changes and modifications can be made to those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof.

The embodiments in which an exclusive property or privilege is claimed are defined as follows:

1. A bottom hole assembly (BHA) electrically connected to a wireline, the BHA adapted for manipulating one or more target sleeve valves spaced along a wellbore, comprising:

a shifting tool having an element and electrically actuable between a radially outward biased position, a radially outward engaged position, and a radially inward collapsed position;

a sealing element electrically actuable between a radially outward sealing position and a radially inward released position; and electrically actuable slips actuable between a wellbore-engaged position and a released position, wherein when the slips are in the wellbore-engaged position, the slips are engaged with the wellbore and the BHA is restrained to the wellbore;

wherein:

when the shifting tool element is in the biased position, the BHA can be moved along the wellbore and the shifting tool element is adapted to engage a sleeve of a target sleeve valve;

when the shifting tool element is in the engaged position, the shifting tool is locked axially to the target sleeve for operation of the target sleeve valve and adapted to open or close the target sleeve valve;

when the sealing element is the sealing position, an annulus between the wellbore and the BHA is blocked to direct annular fluid through an opened sleeve valve; and when the shifting tool element is in the collapsed position, the BHA can be moved along the wellbore.

2. The BHA of claim 1 further comprising:

an electrically-actuated axial stroking tool located between the slips and the shifting tool wherein, when the slips are in the wellbore-engaged position, the shifting tool is engaged with the target sleeve, and the stroking tool can operate the target sleeve valve between the open and closed or closed and open positions.

3. The BHA of claim 1 further comprising an instrumentation sub comprising one or more sensors for measuring one or more parameters of the wellbore and the BHA, the sensors in communication through the wireline.

4. The BHA of claim 1, wherein the shifting tool element comprises:

a housing;

an actuator; and one or more dogs supported by the housing and radially actuable by the actuator between the biased position, the engaged position and the collapsed position.

5. The BHA of claim 1, wherein each of the sleeves comprises axial engagement ends and the shifting tool element is adapted to engage the sleeves at one or both of the engagement ends to open or close the target sleeve valve.

6. The BHA of claim 1, wherein the shifting tool element comprises:

a housing;

an actuator;

a mandrel axially moveable within the housing by the actuator and having at least three diameters; and a set of fingers radially actuable by the mandrel between the biased position corresponding to a first diameter of the mandrel, the engaged position corresponding to a second diameter of the mandrel, and the collapsed position corresponding to a third diameter of the mandrel.

7. A method of deploying a BHA for fracturing operations connected by a wireline in a casing of a wellbore comprising:

pumping fluid into the wellbore to position the BHA;

radially extending a shifting tool element of the BHA to a biased position to engage walls of a sleeve;

pulling the BHA by the wireline uphole until the shifting tool element of the BHA engages recesses of the sleeve;

setting the shifting tool element of the BHA to an engaged position to axially lock the shifting tool element to the sleeve;

setting a sealing element in the casing to isolate an annular area between the wellbore and the BHA;

pumping fluid into the wellbore to open the sleeve;

pumping fracturing fluid into the annular area;

unsetting the sealing element in the casing;

waiting for pressure uphole and downhole the sealing element to equalize;

retracting the shifting tool element to a collapsed position; and pulling the BHA uphole with the wireline to the next sleeve.

8. The method of claim 7, further comprising the steps of:

setting a set of slips to engage the casing; and closing the sleeve by axially stroking the shifting tool element while the BHA is axially fixed to the casing.

9. The method of claim 7, further comprising the step of measuring axial force on the wireline using a sensor and communicating axial force measurements through the wireline for observing wireline load.

10. The method of claim 7 wherein the step of pulling the BHA by the wireline uphole further comprises measuring axial force on the wireline using a sensor and communicating axial force measurements through the wireline to determine whether the shifting tool element is in the biased position, the engaged position or the collapsed position.

11. The method of claim 7 wherein the step of setting the sealing element further comprises measuring pressure proximate the sealing element using a sensor and communicating pressure measurements through the wireline to determine whether the sealing element is in a sealing position or a released position.

12. The method of claim 7 wherein the step of pumping fracturing fluid into the annular area further comprises measuring pressure uphole and downhole of the sealing element in the wellbore using sensors and communicating pressure measurements through the wireline for confirming a level of isolation provided by the sealing element.

13. The method of claim 7 wherein the step of pumping fracturing fluid into the annular area further comprises measuring fluid pressure in the wellbore using a sensor and communicating pressure measurements through the wireline for observing parameters of a potential screen-out of the wellbore.

14. A method of deploying a BHA for fracturing operations connected by a wireline in a casing of a wellbore comprising:

pumping fluid into the wellbore to position the BHA;

radially extending a shifting tool element of the BHA to a biased position to engage walls of a sleeve;

pulling the BHA by the wireline uphole until the shifting tool element of the BHA engages recesses of the sleeve;

setting the shifting tool element of the BHA to an engaged position to axially lock the shifting tool element to the sleeve;

setting a set of slips to engage the casing;

opening the sleeve by axially stroking the shifting tool element while the BHA is axially fixed to the casing;

setting a sealing element in the casing to isolate an annular area between the wellbore and the BHA;

pumping fracturing fluid into the annular area;

unsetting the sealing element in the casing;

waiting for pressure uphole and downhole the sealing element to equalize;

closing the sleeve by axially stroking the shifting tool element while the BHA is axially fixed to the casing;

releasing the set of slips;

retracting the shifting tool element to a collapsed position; and pulling the BHA uphole with the wireline to the next sleeve.

15. The method of claim 14, further comprising the step of measuring axial force on the wireline using a sensor and communicating axial force measurements through the wireline for observing wireline load.

16. The method of claim 14 wherein the step of pulling the BHA by the wireline uphole further comprises measuring axial force on the wireline using a sensor and communicating axial force measurements through the wireline to determine whether the shifting tool element is in the biased position, the engaged position or the collapsed position.

17. The method of claim 14 wherein the step of setting the sealing element further comprises measuring pressure proximate the sealing element using a sensor and communicating pressure measurements through the wireline to determine whether the sealing element is in a sealing position or a released position.

18. The method of claim 14 wherein the step of pumping fracturing fluid into the annular area further comprises measuring pressure uphole and downhole of the sealing element in the wellbore using sensors and communicating pressure measurements through the wireline for confirming a level of isolation provided by the sealing element.

19. The method of claim 14 wherein the step of pumping fracturing fluid into the annular area further comprises measuring fluid pressure in the wellbore using a sensor and communicating pressure measurements through the wireline for observing parameters of a potential screen-out of the wellbore.

* * * * *